United States Patent [19]

Sugita et al.

[11] Patent Number: 4,528,263

[45] Date of Patent: Jul. 9, 1985

[54] LIGHT-SENSITIVE SILVER HALIDE COLOR PHOTOGRAPHIC MATERIAL

[75] Inventors: Hiroshi Sugita; Yasuo Tsuda; Kenji Ito; Satoru Shimba, all of Hino, Japan

[73] Assignee: Konishiroku Photo Industry Co., Ltd., Tokyo, Japan

[21] Appl. No.: 583,948

[22] Filed: Feb. 27, 1984

Related U.S. Application Data

[63] Continuation of Ser. No. 468,395, Feb. 22, 1983, Pat. No. 4,434,225.

[30] Foreign Application Priority Data

| | | | |
|---|---|---|---|
| Feb. 24, 1982 | [JP] | Japan | 57-29556 |
| Feb. 26, 1982 | [JP] | Japan | 57-30849 |
| Feb. 27, 1982 | [JP] | Japan | 57-31888 |

[51] Int. Cl.[3] ..... G03C 7/26

[52] U.S. Cl. ..... 430/544; 430/552; 430/553; 430/558; 430/957

[58] Field of Search ..... 430/544, 552, 553, 558, 430/957

[56] References Cited

U.S. PATENT DOCUMENTS

| | | | |
|---|---|---|---|
| 3,446,622 | 5/1969 | Magagnoli et al. | 430/552 |
| 3,703,375 | 11/1972 | Groet et al. | 430/544 |
| 3,758,308 | 9/1973 | Beavers et al. | 430/553 |
| 3,880,661 | 4/1975 | Lau et al. | 430/553 |
| 4,248,962 | 2/1981 | Lau | 430/544 |
| 4,333,999 | 6/1982 | Lau | 430/553 |
| 4,427,767 | 1/1984 | Aoki et al. | 430/549 |
| 4,434,225 | 2/1984 | Sugita et al. | 430/544 |

FOREIGN PATENT DOCUMENTS 1011940 12/1965 United Kingdom .

*Primary Examiner*—J. Travis Brown

*Attorney, Agent, or Firm*—Frishauf, Holtz, Goodman & Woodward

[57] ABSTRACT

Disclosed is a light-sensitive silver halide color photographic material having at least one light-sensitive silver halide emulsion layer on a support, characterized in that said light-sensitive silver halide emulsion layer contains a cyan coupler represented by the formula [I] shown below, and said light-sensitive silver halide emulsion layer and/or a layer contiguous to said light-sensitive silver halide emulsion layer contains at least one of a timing DIR compound represented by the formula [II] shown below and a non-timing type DIR compound:

Formula [I]

wherein X, $R_1$ and $R_2$ are as defined in the specification;

Formula [II]

wherein Cp, TIME and Z are as defined in the specification.

2 Claims, No Drawings

LIGHT-SENSITIVE SILVER HALIDE COLOR PHOTOGRAPHIC MATERIAL

This is a continuation of application Ser. No. 468,395 filed Feb. 22, 1983, which issued as U.S. Pat. No. 4,434,225 on Feb. 28, 1984.

This invention relates to a light-sensitive silver halide color photographic material, more particularly to a light-sensitive silver halide color photographic material which is good in gradation of the characteristic curve and improved in graininess, sharpness and the inter-image effect.

Heretofore, a napthol type cyan coupler has been used in a red sensitive emulsion layer of a high sensitivity light-sensitive color nega material. This has been utilized in practical application because of the specific feature that the absorption spectrum of the cyan dye formed by the reaction with an oxidized product of a color developing agent has absorptions primarily at the longer wavelength region with little secondary absorption at the green region and preferred in connection with color reproduction.

On the other hand, in recent years, light-sensitive color nega materials tend to be shifted toward light-sensitive materials of high sensitivity and high image quality (graininess, sharpness). For accomplishment of this object, high sensitization has been made possible by development of a two-equivalent cyan coupler, such as the compounds disclosed in Japanese Provisional Patent Publication Nos. 117422/1975 and 32071/1980. However, high sensitization accompanies deterioration in graininess and sharpness. For prevention of such deterioration, it has been proposed to use a DIR compound capable of releasing imagewisely a developing inhibitor in combination (e.g. compounds as disclosed in U.S. Pat. No. 3,227,554, Japanese Provisional Patent Publication No. 77635/1974), whereby a light-sensitive material of high sensitivity and high quality can be accomplished.

However, under the present situation, where the policy for saving resources is prevailing in view of the problem of exhaustion of silver and others, there is a trend for light-sensitive color nega materials to shift toward smaller formatting of light-sensitive materials. However, such light-sensitive materials must obtain more information on a minute area than those of the prior art. For this reason, further improvement of graininess and sharpness would be desirable. For solving this problem, a large amount of a DIR compound may be used, whereby image quality can be improved, but difficulty is encountered in adjustment of gradation by use of the above naphthol type cyan coupler. When the amount of a coupler is increased in order to cover the adjustment of gradation, image quality is deteriorated, while increase in amount of silver will result disadvantageously in reducing color fading of a cyan dye by reduced ferrous ions produced in a large amount in the step of bleaching processing. Thus, it has been impossible to accomplish a light-sensitive material of small format having high sensitivity and high image quality according to the technique in which a naphthol type cyan coupler and a DIR compound are used in combination.

On the other hand, as couplers having absorption spectra similar to naphthols which can improve color fading of dyes during bleaching processing, there have been known those as disclosed in Japanese Provisional Patent Publication Nos. 65134/1981, 204543/1982, 204544/1982 and 204545/1982, Japanese Patent Application Nos. 131312/1981, 131313/1981 and 131314/1981. These couplers are known to give no fading of cyan dyes with good gradation and also improve image quality when used in combination with the compounds capable of releasing directly developing inhibitors through the coupling reaction with oxidized products of color developing agents (hereinafter called as non-timing DIR) or the compounds capable of releasing developing inhibitors having timing groups after being eliminated from the coupling position (hereinafter called as timing DIR) as disclosed in U.S. Pat. No. 4,248,962 or Japanese Provisional Patent Publication No. 114946/1981. However, none of these techniques known in the art can give small formatted sensitive materials which can satify both characteristics of graininess and sharpness at the same time.

In view of the state of the art, we have made extensive studies and consequently found that, by using a cyan coupler represented by the formula [I] in combination with at least one of a timing DIR compound represented by the formula [II] and a non-timing type DIR compound, there can be obtained better results than those in case of using in combination a DIR compound of the prior art as described above, namely the effect of better gradation (high sensitivity) with improvements of both characateristics of graininess and sharpness at the same time.

Accordingly, an object of this invention is to provide a light-sensitive silver halide color photographic material having good gradation characteristic (high sensitivity).

Another object of this invention is to provide a light-sensitive silver halide color photographic material improved in sharpness and the inter-image effect.

Still another object of this invention is to provide a light-sensitive silver halide color photographic material improved in reducing color fading of a cyan dye during bleachig treatment.

Further, still another object of this invention is to provide a light-sensitive silver halide color photographic material decreased in amount of the coated silver.

These and other objects of this invention have been accomplished by providing

[A]: a light-sensitive silver halide color photographic material having at least one light-sensitive silver halide emulsion layer on a support, characterized in that said light-sensitive silver halide emulsion layer contains a cyan coupler represented by the formula [I] shown below, and said light-sensitive silver halide emulsion layer and/or a layer contiguous to said light-sensitive halide emulsion layer contains a non-timing type DIR compound:

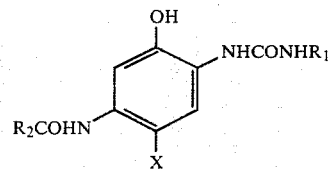

Formula [I]

wherein X represents a hydrogen atom or an eliminable group through coupling with an oxidized product of an aromatic primary amine color developing agent; $R_1$ represents a naphthyl group or a heterocyclic group (provided that a carbon atom of a heterocyclic group is bonded to the nitrogen atom of the ureido group), or a phenyl group having at least one substituent (with proviso that, when having a cyano at the p-position relative to the ureido group, the four positions of o-position and m-position relative to the ureido group cannot have hydrogen atoms at the same time) selected from the group consisting of a trifluoromethyl, a nitro, a cyano,

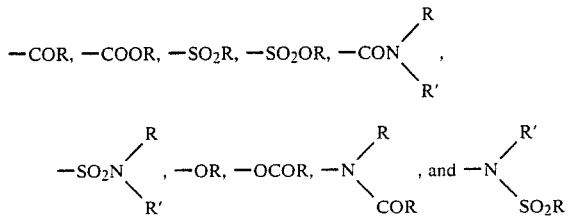

(where R represents an aliphatic group or an aromatic group, and R′ represents a hydrogen atom, an aliphatic group or an aromatic group); and $R_2$ represents an aliphatic group or an aromatic group necessary to impart diffusion resistance to the cyan dyes formed from the cyan couplers represented by the formula [I] and the cyan dyes to be formed from said cyan coupler;

[B]: a light-sensitive silver halide color photographic material having at least one light-sensitive silver halide emulsion layer on a support, characterized in that said light-sensitive silver halide emulsion layer contains a cyan coupler represented by the formula [I] shown below, and said light-sensitive silver halide emulsion layer and/or a layer contiguous to said light-sensitive silver halide emulsion layer contains a timing DIR compound represented by the formula [II]:

Formula [I]

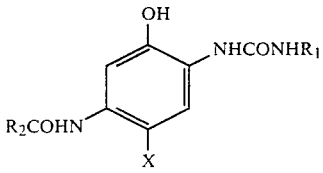

wherein X represents a hydrogen atom or an eliminable group through coupling with an oxidized product of an aromatic primary amine color developing agent; $R_1$ an aryl group such as a phenyl group, a naphthyl group or the like, or a heterocyclic group; and $R_2$ a ballast group necessary for imparting diffusion resistance to a cyan coupler represented by the above formula [I] and a cyan dye to be formed from said cyan coupler, Formula [II]

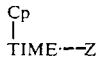

wherein Cp represents a coupling component reactive with an oxidized product of an aromatic primary amine color developing agent, TIME represents a timing group which releases Z after the coupling reaction of Cp and Z represents a development inhibitor; or

[C]: a light-sensitive silver halide color photographic material having at least one light-sensitive silver halide emulsion layer on a support, characterized in that said light-sensitive silver halide emulsion layer contains a cyan coupler represented by the formula [I] shown below, and said light-sensitive silver halide emulsion layer and/or a layer contiguous to said light-sensitive silver halide emulsion layer contains a timing DIR compound represented by the formula [II] shown below and a non-timing type DIR compound:

Formula [I]

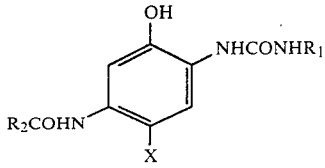

wherein X represents a hydrogen atom or an eliminable group through coupling with an oxidized product of an aromatic primary amine color developing agent; $R_1$ an aryl group such as a phenyl group, a naphthyl group or the like, or a heterocyclic group; and $R_2$ a ballast group necessary for imparting diffusion resistance to a cyan coupler represented by the above formula [I] and a cyan dye to be formed from said cyan coupler, Formula [II]

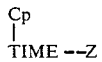

wherein Cp represents a coupling component reactive with an oxidized product of an aromatic primary amine color developing agent, TIME represents a timing group which releases Z after the coupling reaction of Cp and Z represents a development inhibitor.

Preferable cyan couplers according to the formula [I] of this invention are represented typically by the following formula [Ia] or [Ib]:

Formula [Ia]

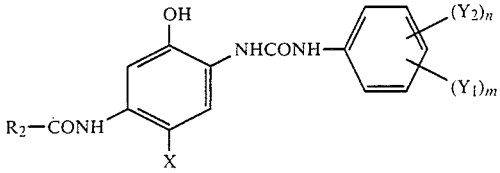

Formula [Ib]

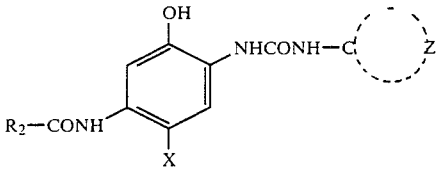

In the above formulae, $Y_1$ represents a trifluoromethyl, a nitro, a cyano or a group represented by

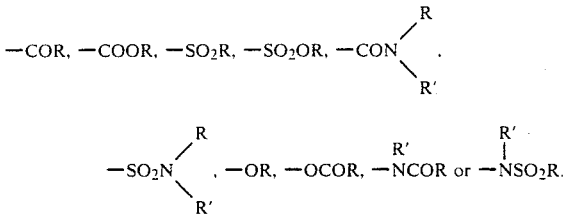

R represents an aliphatic group [preferably an alkyl group having 1 to 10 carbon atoms (e.g. methyl, butyl, cyclohexyl, benzyl)] or an aromatic group [preferably a phenyl group (e.g. phenyl or tolyl)], and R′ represents a hydrogen atom or a group represented by R.

$Y_2$ represents a monovalent group, preferably an aliphatic group [preferably an alkyl group having 1 to 10 carbon atoms (e.g. methyl, t-butyl, ethoxyethyl, cyanomethyl)], an aromatic group [preferably a phenyl group, a naphthyl group (e.g. phenyl, tolyl)], a halogen atom (fluorine, chlorine, bromine or the like), an amono group (e.g. ethylamino, diethylamino), a hydroxy group or a substituent represented by $Y_1$. m is an integer of 1 to 3, and n is an integer of 0 to 3. More preferably, m+n should be 2 or more.

Z represents a group of non-metallic atoms necessary for forming a heterocyclic group or a naphthyl group, and the a heterocyclic group is preferably a five-membered or six-membered heterocyclic group containing 1 to 4 hetero atoms selected from nitrogen atoms, oxygen atoms or sulfur atoms.

For example, there may be included a furyl group, a thienyl group, a pyridyl group, a quinonyl group, an oxazolyl group, a tetrazolyl group, a benzothiazolyl group, a tetrahydrofuranyl group and the like.

These rings may have any desired substituents incorporated therein, including, for example, alkyl groups having 1 to 10 carbon atoms (e.g. ethyl, i-propyl, i-butyl, t-butyl, t-octyl, and the like), aryl groups (e.g. phenyl, naphthyl), halogen atoms (e.g. fluorine, chlorine, bromine and the like), cyano, nitro, sulfonamide groups (e.g. methanesulfonamide, butanesulfonamide, p-toluenesulfonamide and the like), sulfamoyl groups (e.g. methylsulfamoyl, phenylsulfamoyl and the like), sulfonyl groups (e.g. methanesulfonyl, p-toluenesulfonyl and the like), fluorosulfonyl groups, carbamoyl groups (e.g. dimethylcarbamoyl, phenylcarbamoyl and the like), oxycarbonyl groups (e.g. ethoxycarbonyl, phenoxycarbonyl and the like), acyl groups (e.g. acetyl, benzoyl and the like), heterocyclic groups (e.g. pyridyl group, pyrazolyl group and the like), alkoxy groups, aryloxy groups, acyloxy groups, and so on.

$R_2$ represents an aliphatic group or an aromatic group necessary for imparting diffusion resistance to a cyan coupler represented by the above formula [I] or a cyan dye to be formed from said cyan coupler, preferably an alkyl group having 4 to 30 carbon atoms, an aryl group or a heterocyclic group. For example, there may be included a straight or branched alkyl group (e.g. t-butyl, n-octyl, t-octyl, n-dodecyl and the like), an alkenyl group, a cycloalkyl group, a five-membered or six-membered heterocyclic group or a group represented by the formula [Ic]:

Formula [Ic]

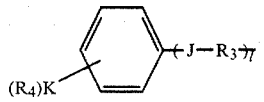

In the above formula, J represents an oxygen atom or a sulfur atom; K represents an integer of 0 to 4, and l represents an integer of 0 or 1; when K is 2 or more, two or more existing $R_4$'s may be the same or different; $R_3$ represents a straight or branched alkyl having 1 to 20 carbon atoms; and $R_4$ represents a monovalent atom or group, including, for example, a hydrogen atom, a halogen atom (preferably chloro, bromo), an alkyl group {preferably a straight or branched alkyl group having 1 to 20 carbon atoms (e.g. methyl, tert-butyl, tert-pentyl, tert-octyl, dodecyl, pentadecyl, benzyl, phenetyl)}, an aryl group (e.g. phenyl), a heterocyclic group (preferably a nitrogen containing heterocyclic group), an alkoxy group {preferably a straight or branched alkyloxy group (e.g. methoxy, ethoxy, tert-butyloxy, octyloxy, decyloxy, dodecyloxy)}, an aryloxy group (e.g. phenoxy), a hydroxy group, an acyloxy group {preferably an alkylcarbonyloxy group, an arylcarbonyloxy group (e.g. acetoxy, benzoyloxy)}, a carboxy group, an alkoxycarbonyl group (preferably a straight or branched alkyloxycarbonyl group having 1 to 20 carbon atoms), an aryloxycarbonyl group (preferably phenoxycarbonyl), an alkylthio group (preferably having 1 to 20 carbon atoms), an acyl group (preferably a straight or branched alkylcarbonyl group having 1 to 20 carbon atoms), an acylamino group (preferably a straight or branched alkylcarboamide, benzenecarboamide having 1 to 20 carbon atoms), a sulfonamide group (preferably a straight or branched alkylsulfonamide group having 1 to 20 carbon atoms, benzenesulfonamide group), a carbamoyl group (preferably a straight or branched alkylaminocarbonyl group having 1 to 20 carbon atoms, phenylaminocarbonyl group), a sulfamoyl group (preferably an alkylaminosulfonyl group having 1 to 20 carbon atoms, phenylaminosulfonyl group) and so on.

X represents a hydrogen atom or an eliminable group during coupling reaction with an oxidized product of a color developing agent. For example, there may be included halogen atoms (e.g. chlorine, bromine, fluorine or the like), aryloxy groups, carbamoyloxy groups, carbamoylmethoxy groups, acyloxy groups, sulfonamide groups, succinimide groups and the like, of which oxygen atom or nitrogen atoms is bonded directly to the coupling position. More specifically, there may be mentioned those as disclosed in U.S. Pat. No. 3,741,563, Japanese Provisional Patent Publication No. 37425/1972, Japanese Patent Publication No. 36894/1973, Japanese Provisional Patent Publication Nos. 10135/1975, 117422/1975, 130441/1975, 108841/1975, 120334/1975, 18315/1977 and 105226/1978.

The cyan coupler according to this invention can readily be synthesized by use of the methods as described in, for example, U.S. Pat. No. 3,758,308 and Japanese Provisional Patent Publication No. 65134/1981.

Preferable compounds of the cyan coupler of the formula [I] are exemplified below, but the present invention is not limited thereby.

(1)

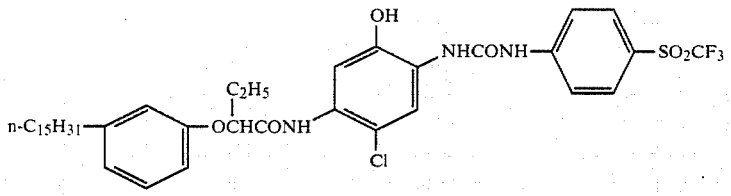

-continued
(2)
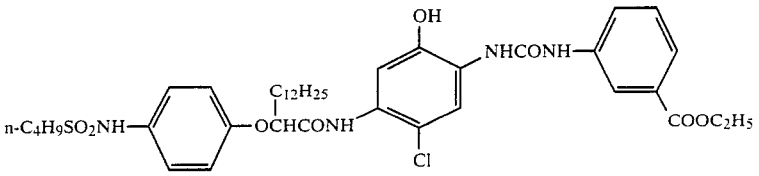
(3)
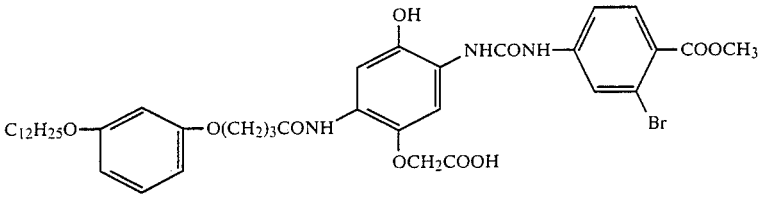
(4)
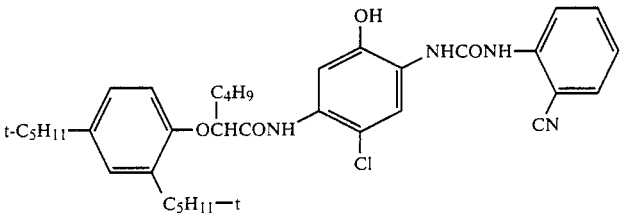
(5)
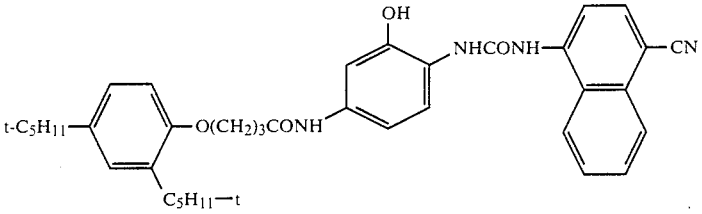
(6)
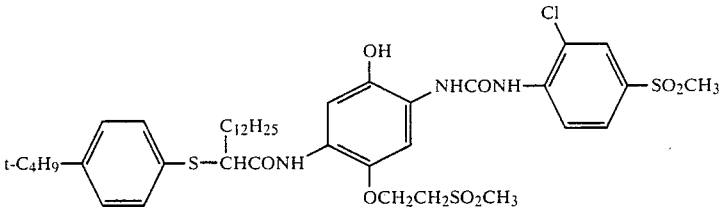
(7)
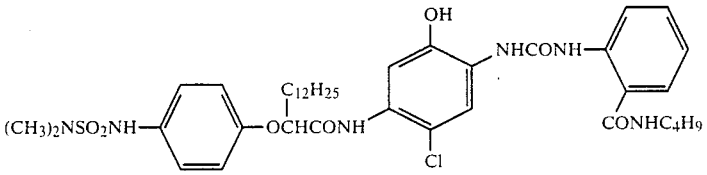
(8)
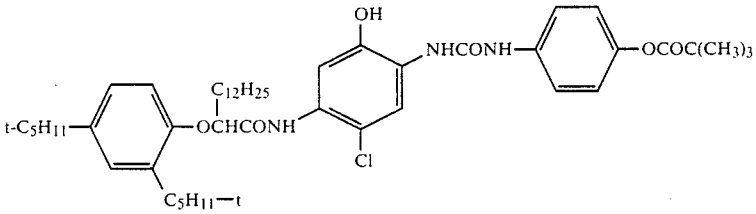

-continued
(9)
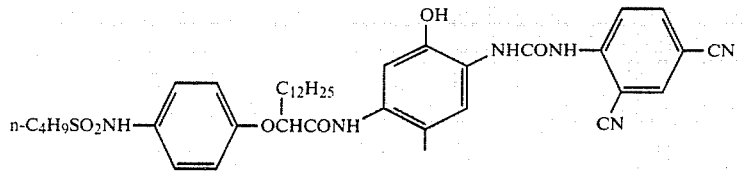
(10)
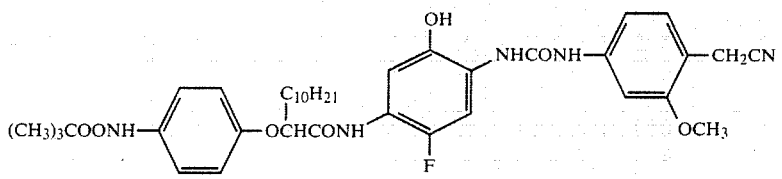
(11)
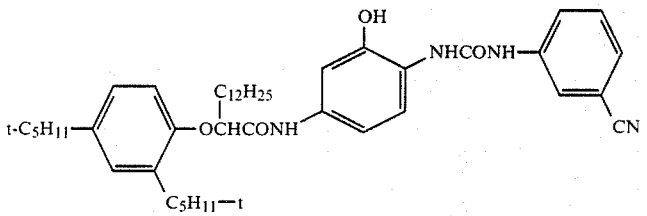
(12)
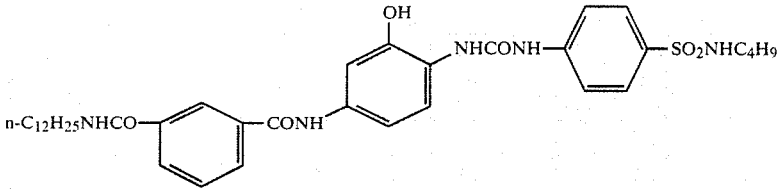
(13)
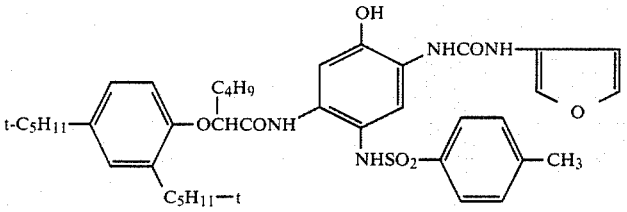
(14)
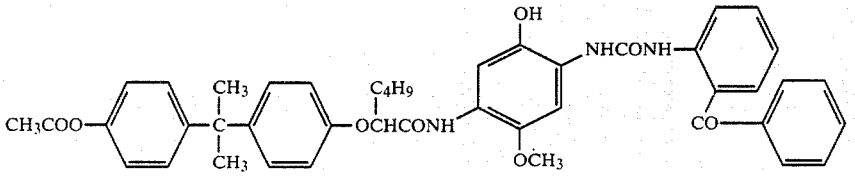
(15)
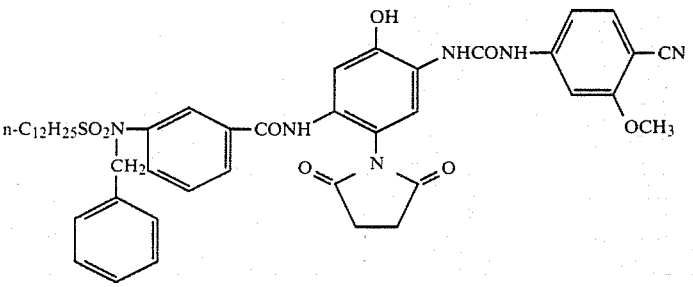

-continued
(16)
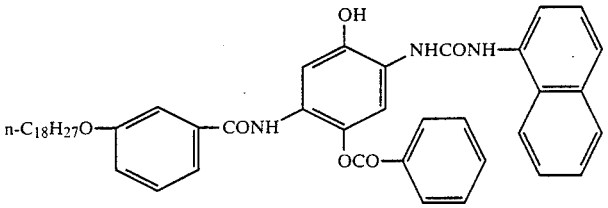
(17)
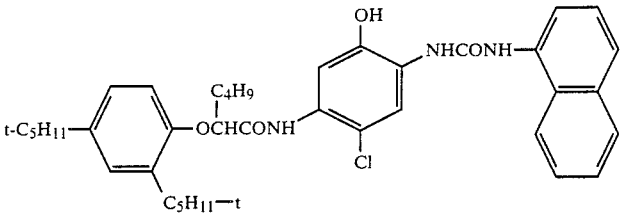
(18)
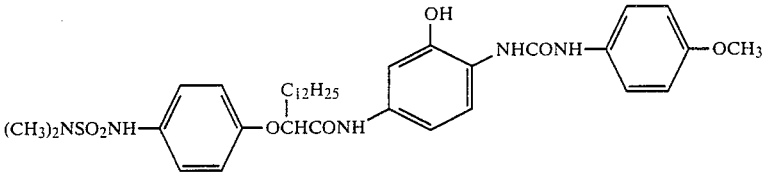
(19)
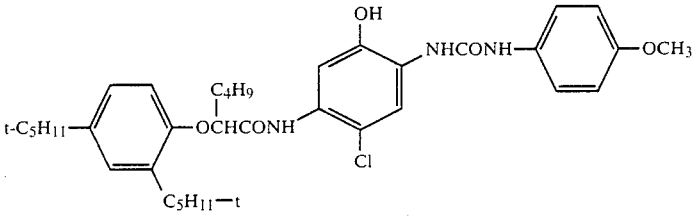
(20)
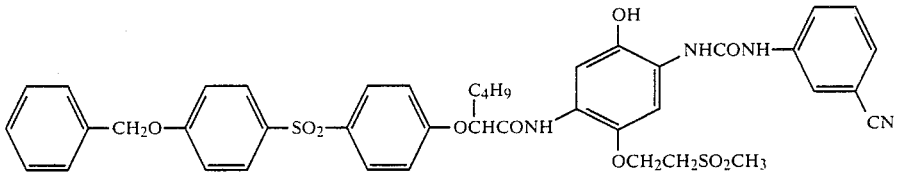
(21)
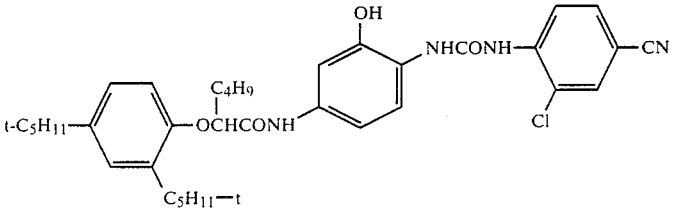
(22)
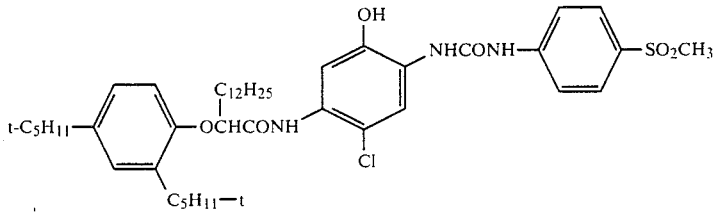

-continued
(23)
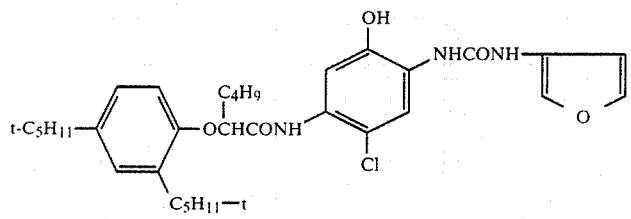
(24)
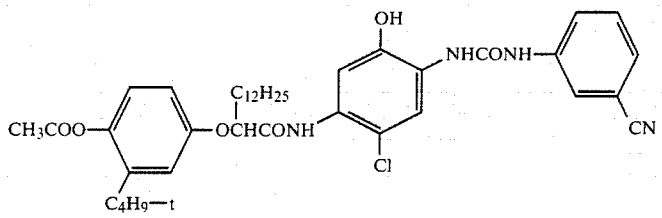
(25)
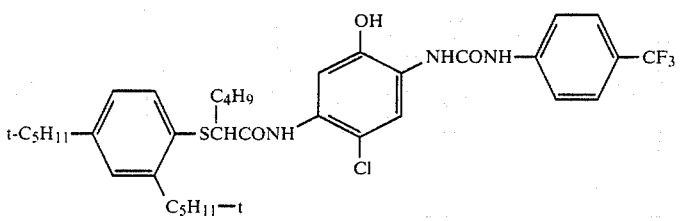
(26)
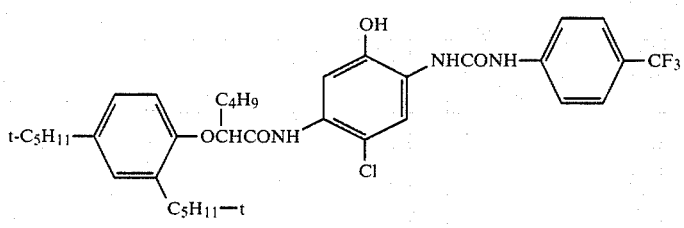
(27)
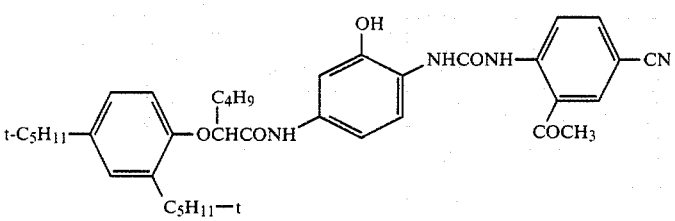
(28)
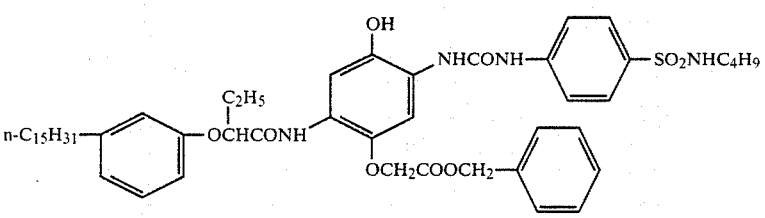
(29)
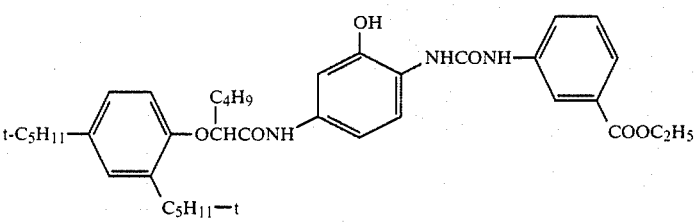

-continued
(30)
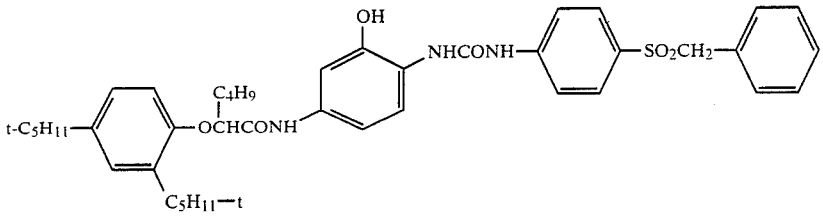
(31)
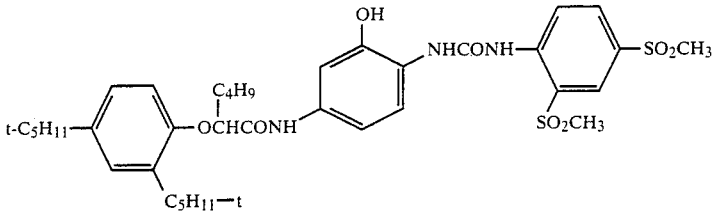
(32)
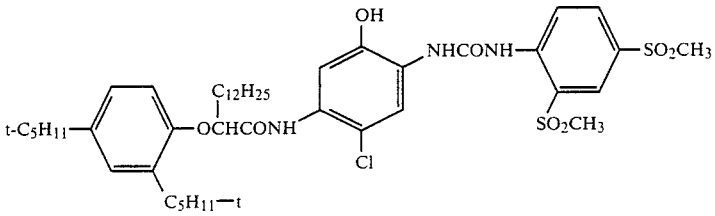
(33)
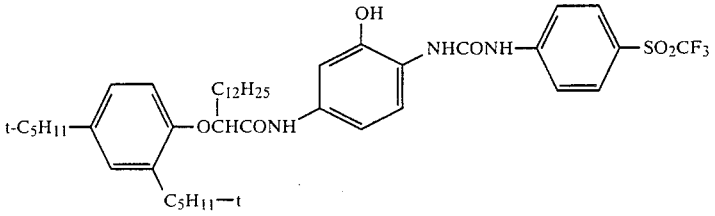
(34)
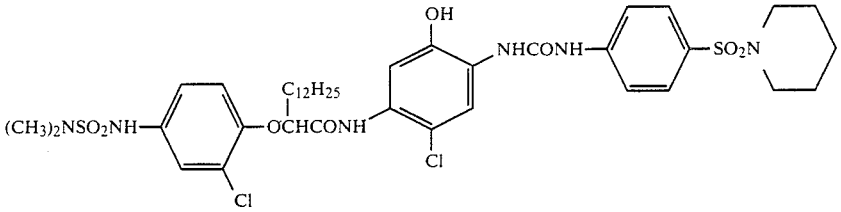
(35)
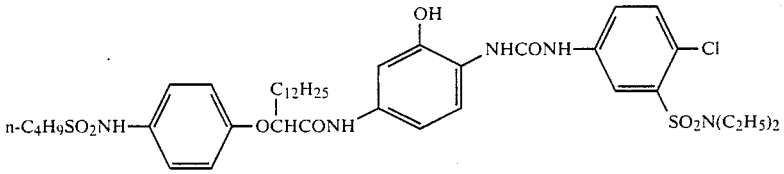
(36)
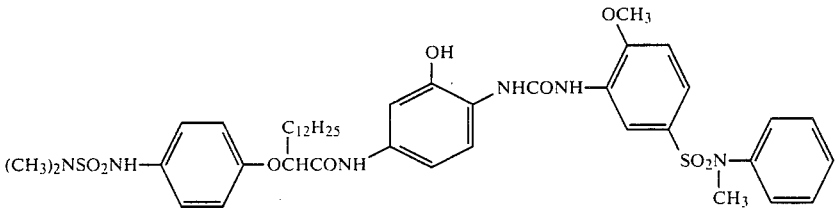

-continued
(37)
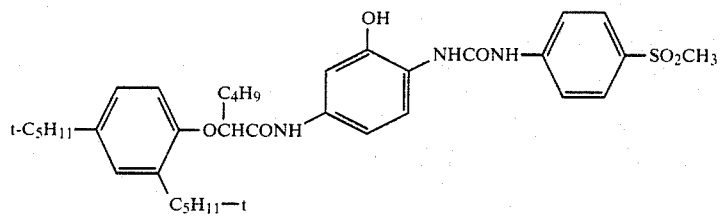
(38)
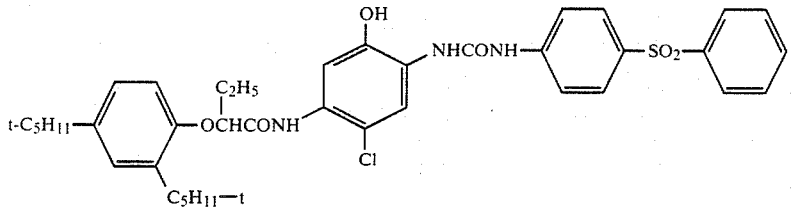
(39)
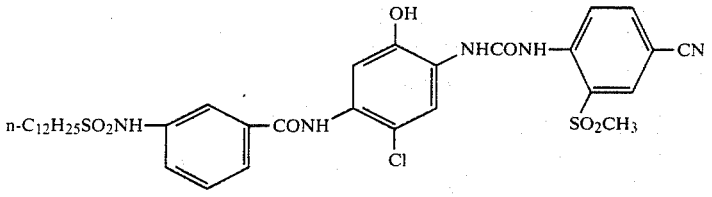
(40)
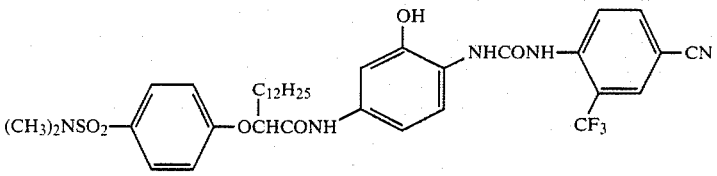
(41)
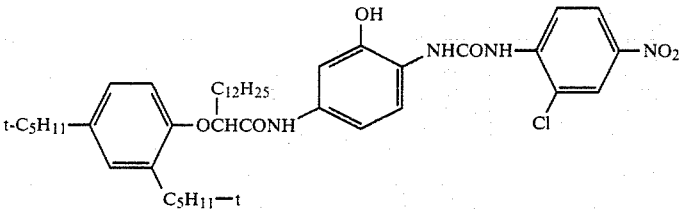
(42)
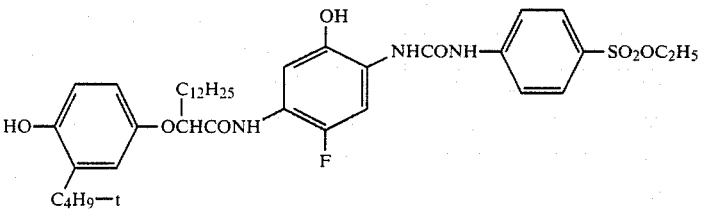
(43)
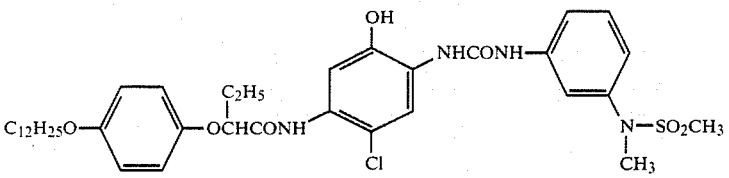

-continued
(44)
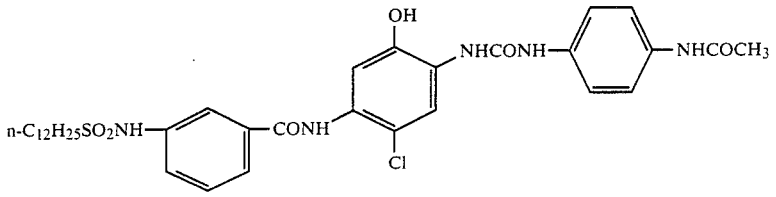
(45)
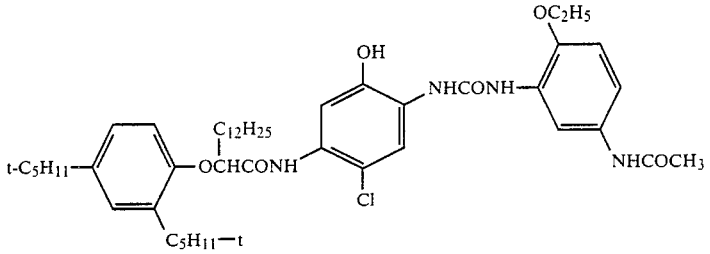
(46)
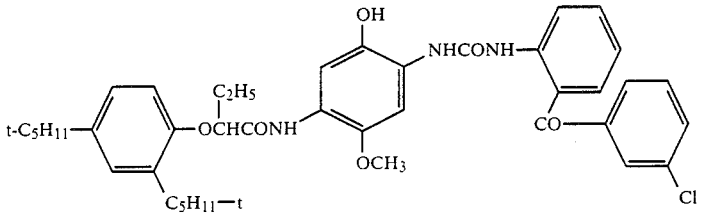
(47)
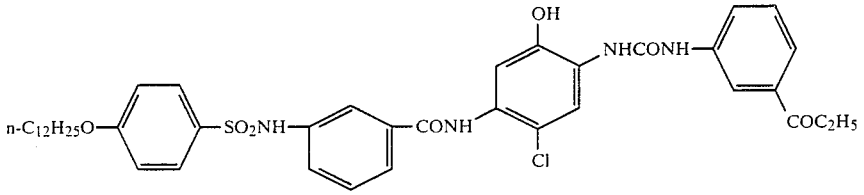
(48)
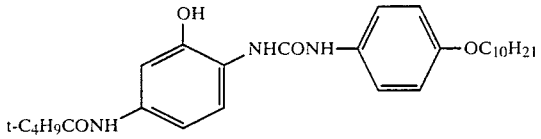
(49)
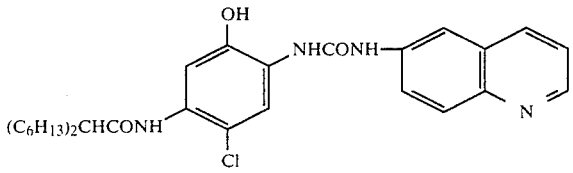
(50)
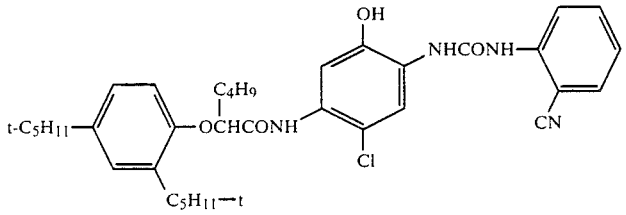

-continued
(51)
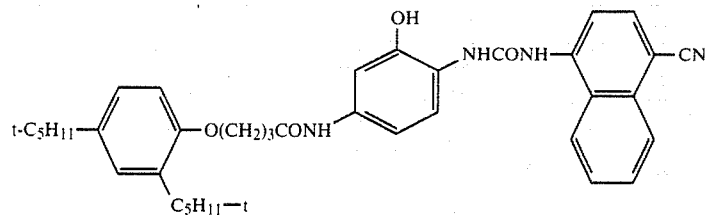
(52)
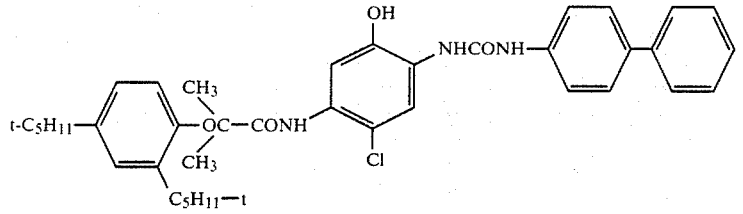
(53)
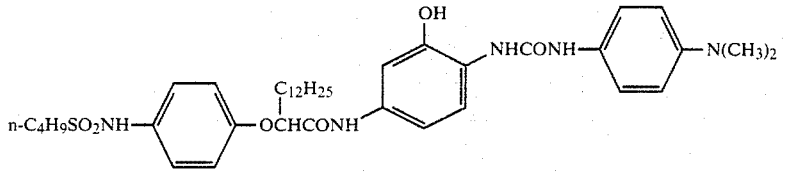
(54)
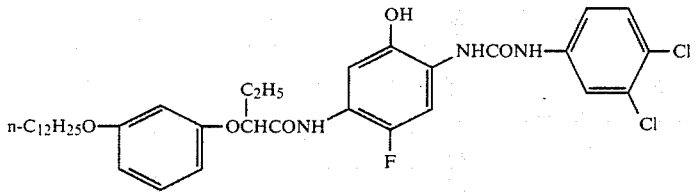
(55)
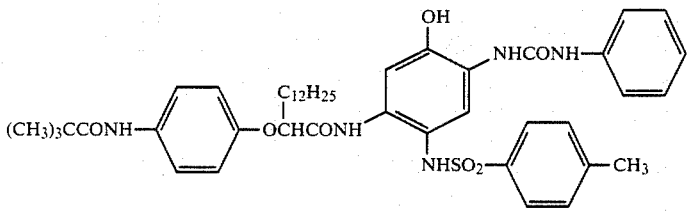
(56)
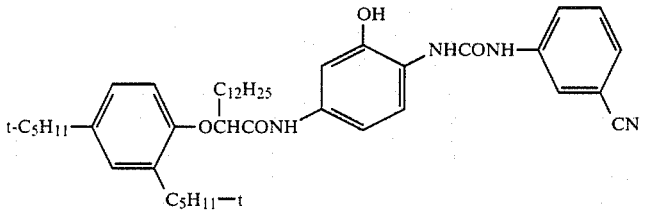
(57)
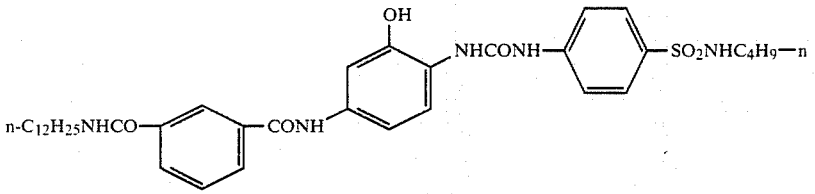

-continued
(58)
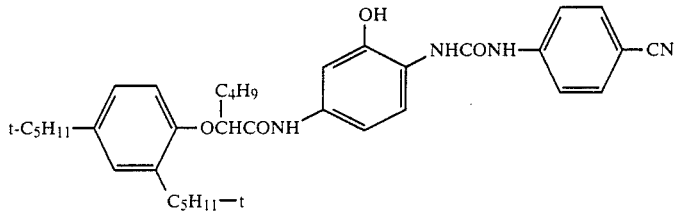
(59)
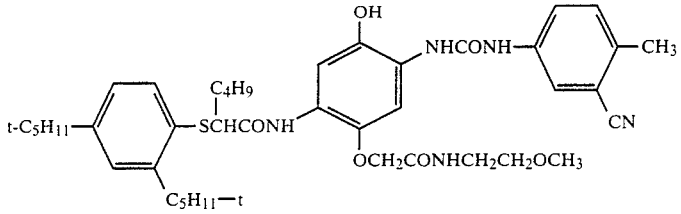
(60)
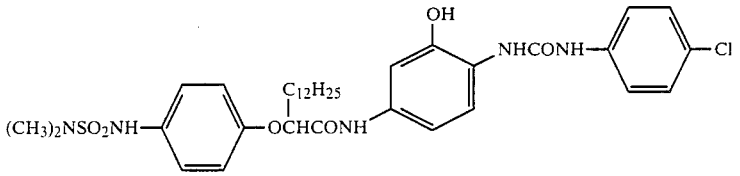
(61)
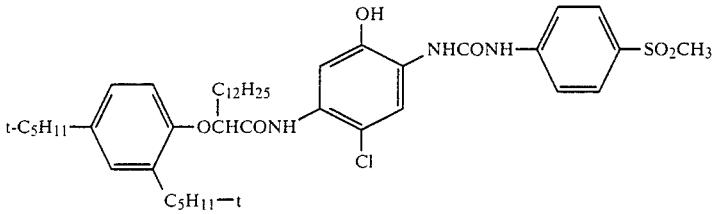
(62)
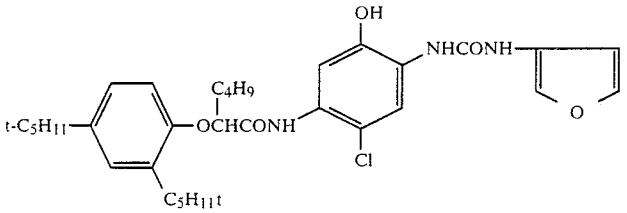
(63)
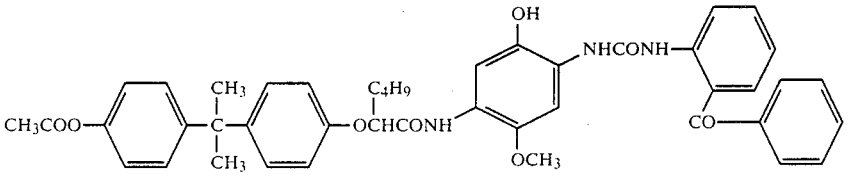
(64)
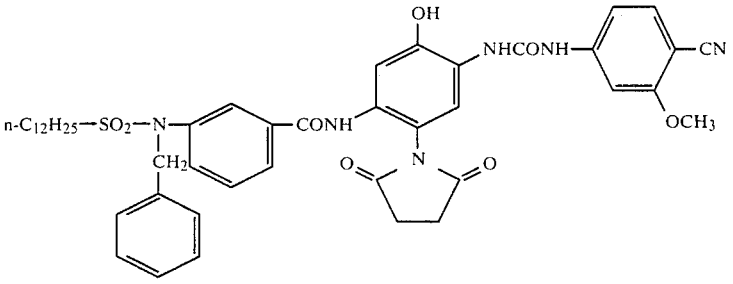

-continued
(65)
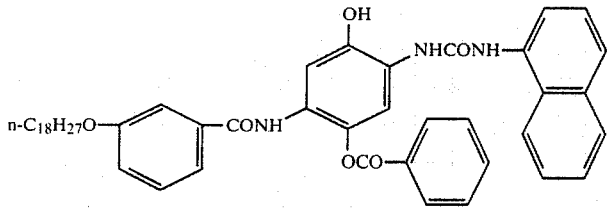
(66)
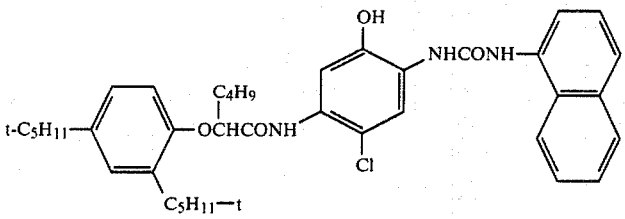
(67)
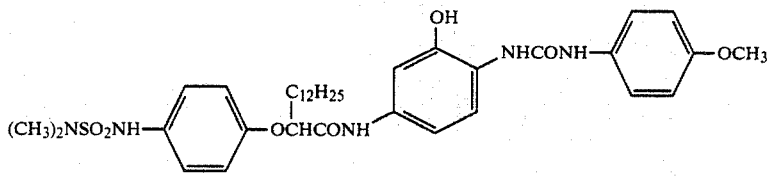
(68)
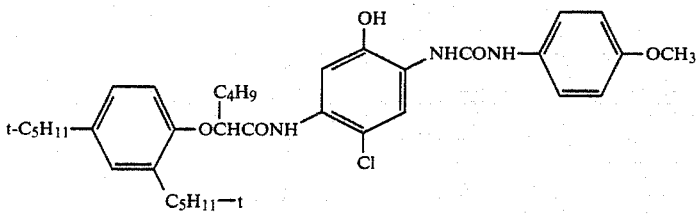
(69)
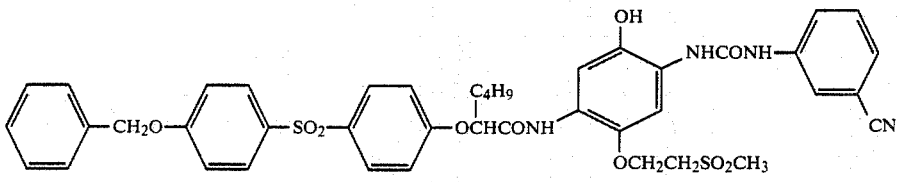
(70)
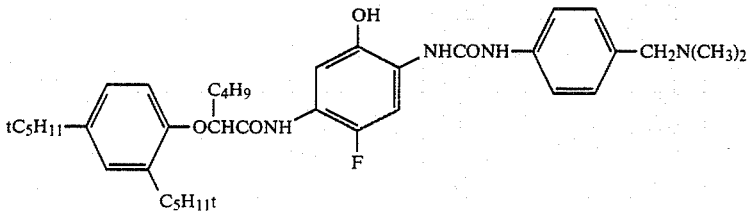
(71)
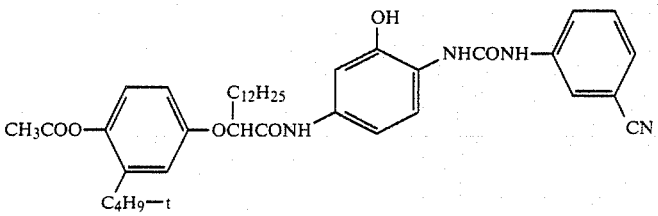

-continued
(72)
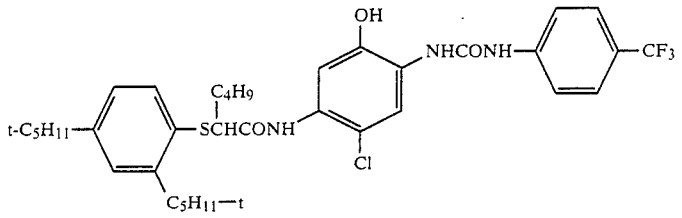
(73)
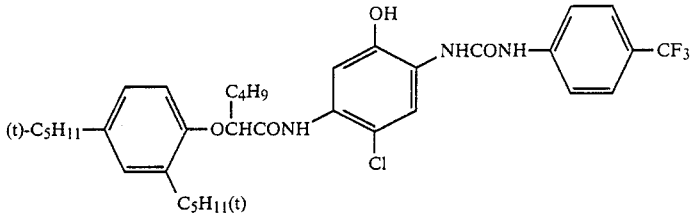
(74)
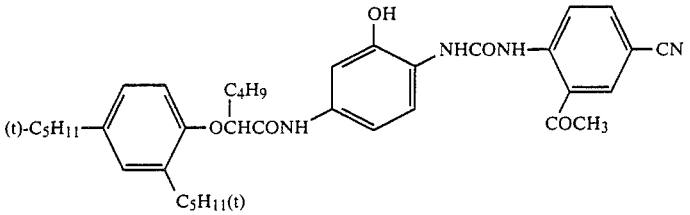
(75)
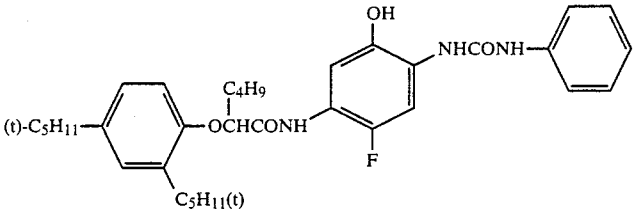
(76)
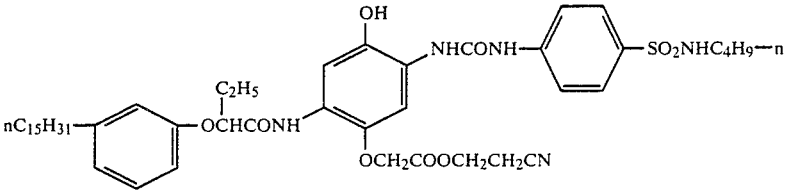
(77)
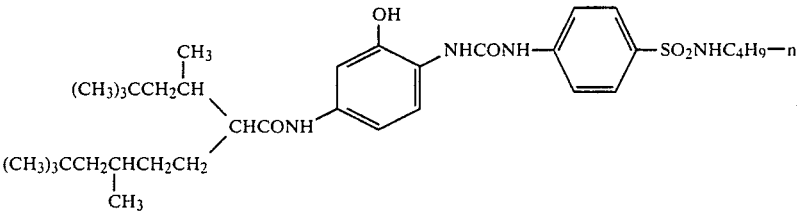
(78)
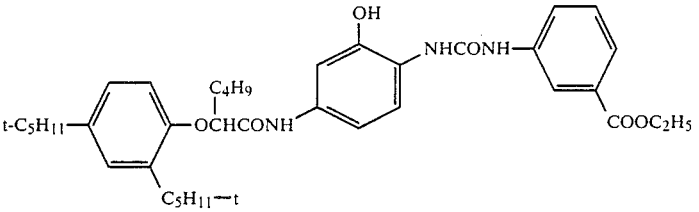

-continued
(79)
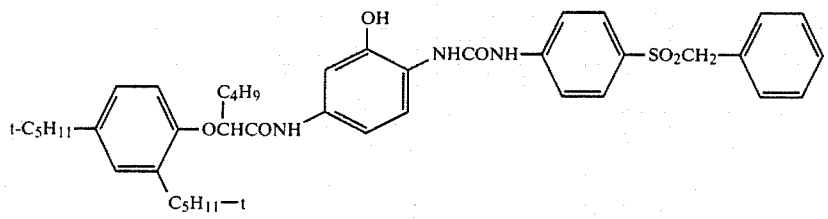
(80)
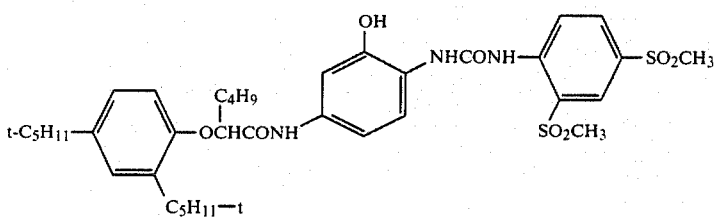
(81)
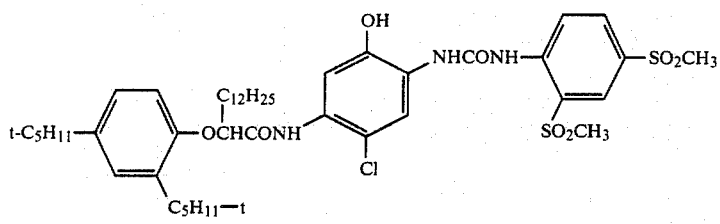
(82)
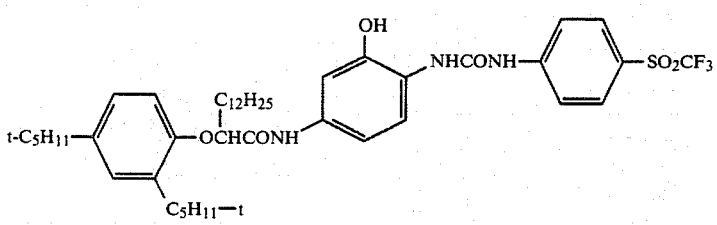
(83)
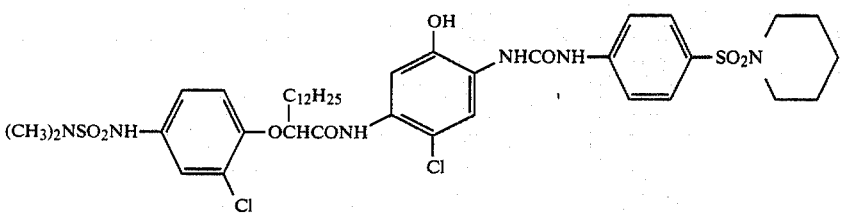
(84)
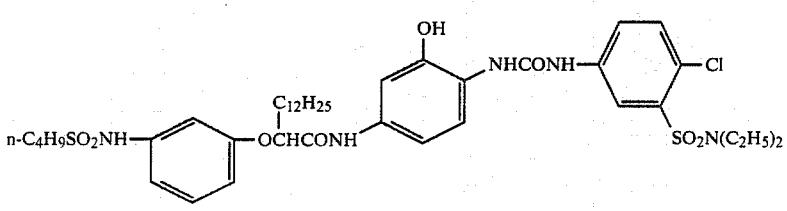
(85)
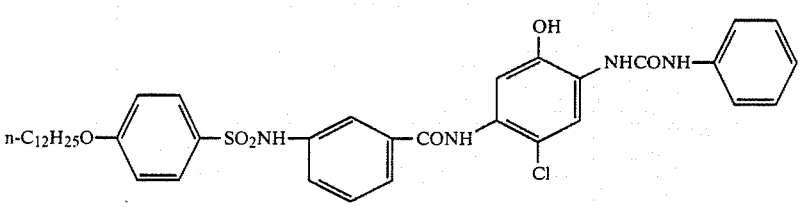

-continued
(86)
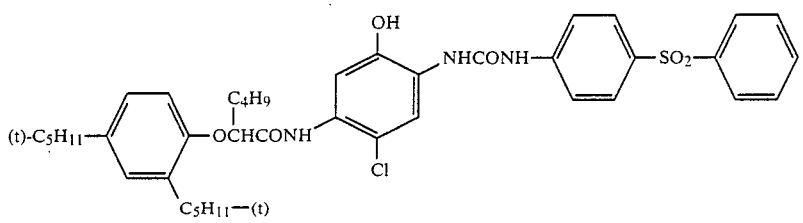
(87)
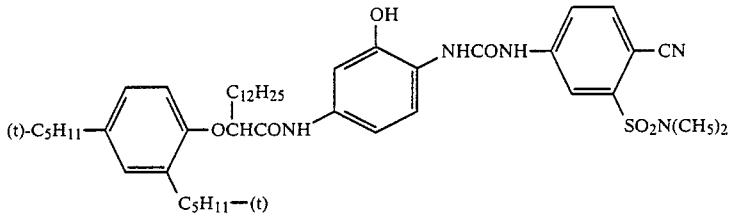
(88)
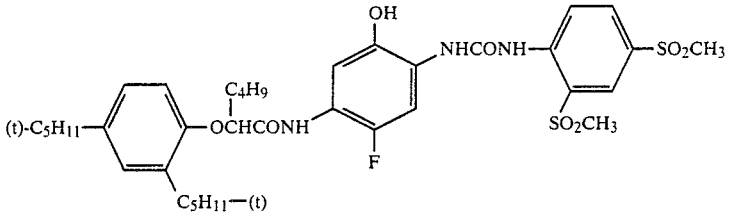
(89)
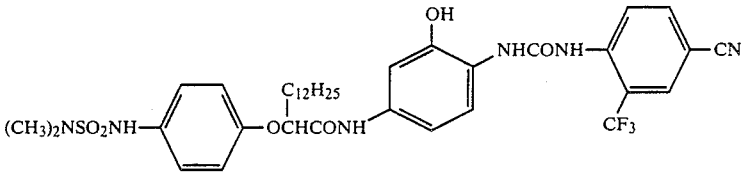
(90)
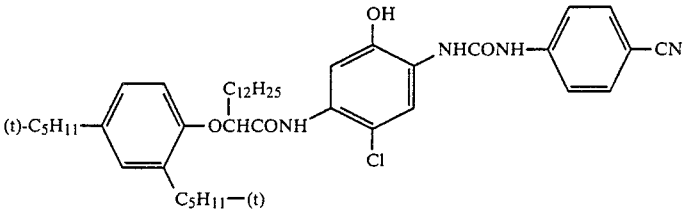
(91)
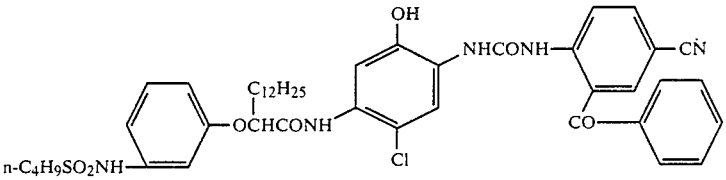
(92)
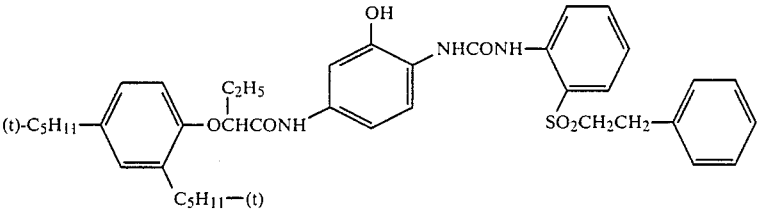

-continued
(93)
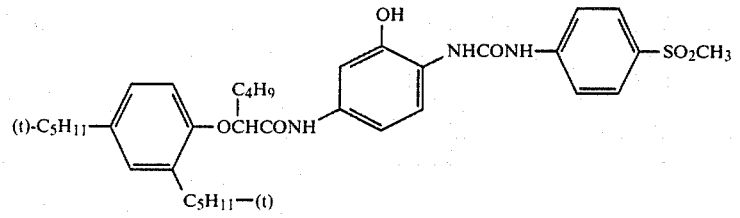
(94)
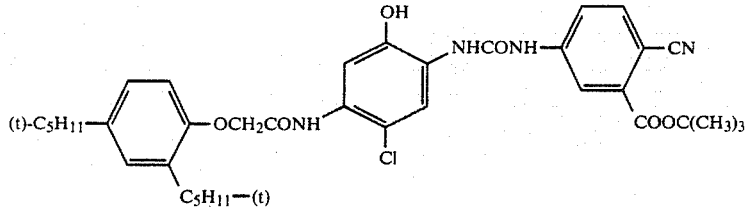
(95)
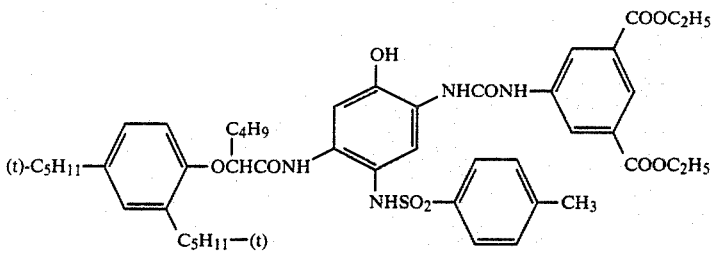
(96)
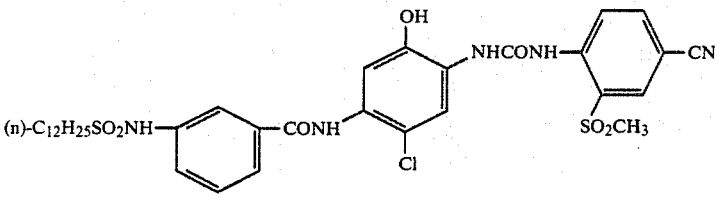
(97)
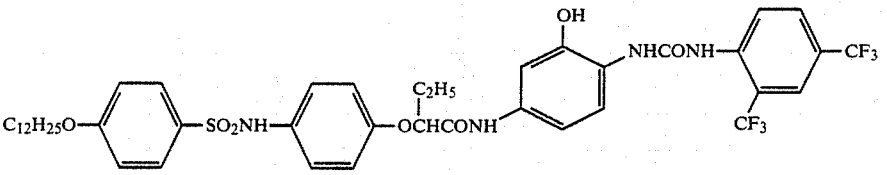
(98)
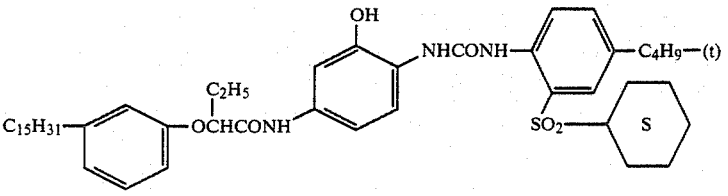
(99)
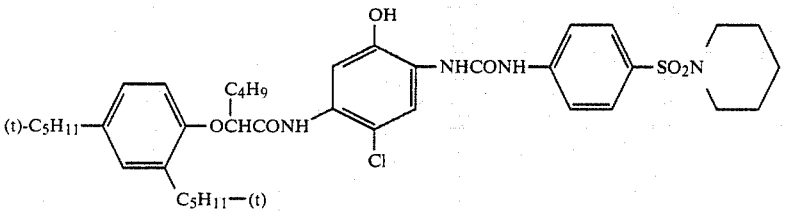

-continued (100)

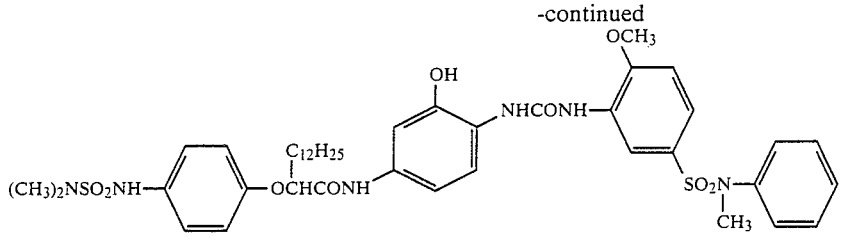

(101)

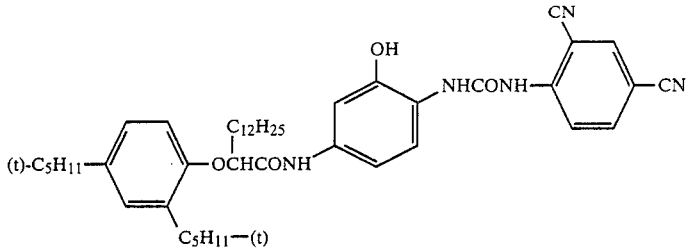

(102)

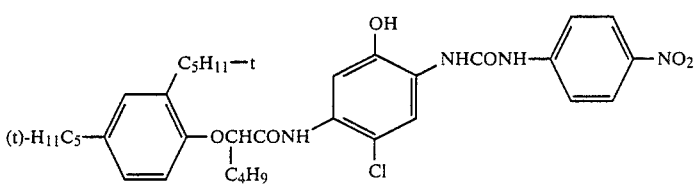

(103)

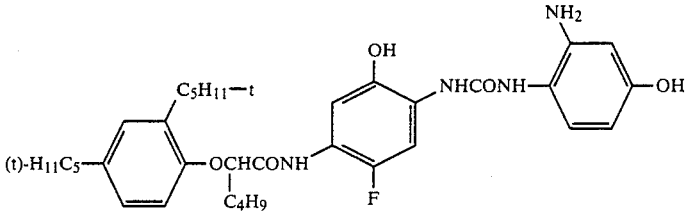

(104)

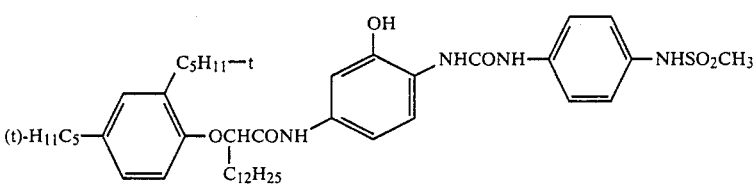

Cp
|
TIME--Z Formula [II]

In the above formula, Cp represents a coupling component reactive with an oxidized product of an aromatic primary amine color developing agent, TIME represents a timing group which releases Z after the coupling reaction of Cp and Z represents a development inhibitor. As the coupling component represented by Cp, there may be employed color forming couplers generally used in conventional light-sensitive color photographic materials, including, for example, benzoylacetanilide type yellow couplers or pivaloylacetamilide type yellow couplers as described in U.S. Pat. Nos. 2,298,443; 2,407,210; 2,875,057; 3,048,194; 3,265,506; and 3,447,926; and "Farbkuppler-eine Literaturubersicht" Agfa Mittteilung (Band II), pp.112–126 (1961). As for magenta couplers, it is possible to use various magenta couplers such as pyrazolone type magenta couplers, pyrazolotriazole type magenta couplers, etc., as disclosed in U.S. Pat. Nos. 2,369,189; 2,343,703; 2,311,082; 2,600,788; 2,908,573; 3,062,653; 3,152,896 and 3,519,429; and the aforementioned Agfa Mitteilung (Band II) pp.126–156 (1961).

Further, in case of cyan couplers, there may be employed napthol type or phenol type couplers as disclosed in U.S. Pat. Nos. 2,367,531; 2,423,730; 2,474,293; 2,772,162; 2,895,826; 3,002,836; 3,034,892 and 3,041,236; and the aforementioned Agfa Mitteilung (Band II), pp.156–175 (1961).

In addition to these couplers, it is also possible to use couplers for formation of black dyes as disclosed in German Offenlegungsschrift No. 2,644,915.

On the other hand, there may be also employed as the compounds of this invention those compounds, which can react with an oxidized product of a color developing agent but form no color forming dye, typically cyclic carbonyl compounds. These compounds are described in U.S. Pat. Nos. 3,632,345; 3,928,041; 3,958,993; 3,961,959 and U.K. Pat. No. 861,138.

Preferably, Cp may be a residue of a benzoylacetanilide type or pivaloylacetanilide type yellow coupler, a residue of a 5-pyrazolone type or pyrazoloriazole type magenta coupler or a residue of a naphthol type or phenol type cyan coupler. As a Cp which forms no dye through the coupling reaction, an indanone type residue is preferred.

Preferable TIME may be represented by the following formulae (IV), (V) or (VI).

(IV)

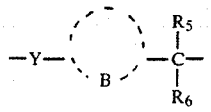

In the above formula, B represents a group of atoms necessary for completion of a benzene ring or a naphthalene ring; Y represents

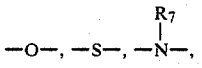

which is bonded to the active site of Cp; $R_5$, $R_6$ and $R_7$ each represents a hydrogen atom, an alkyl group or an aryl group.

The group

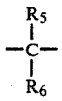

is substituted at an ortho position or a para position relative to Y and bonded to a hetero atom included in Z.

(V)

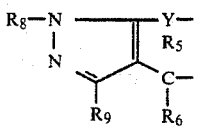

In the above formula [V], Y, $R_5$ and $R_6$ have the same meanings as defined in the formula (IV). $R_8$ represents a hydrogen atom, an alkyl group, an aryl group, an acyl group, a sulfone group, an alkoxycarbonyl group or a heterocyclic ring residue; and $R_9$ represents a hydrogen atom, an alkyl group, an aryl group, a heterocyclic ring residue, an alkoxy group, an amino group, an acid amide group, a sulfonamide group, a carboxylic group, an alkoxycarbonyl group, a carbamoyl group or a cyano group.

This timing group is bonded through Y to the active site of Cp and through

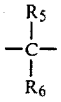

group to a hetero atom in Z.

In the following, there is shown an example of a timing group which releases Z through an intramolecular nucleophilic substitution reaction represented by the formula (VI).

(VI)

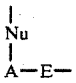

In the above formula [VI], Nu is a nucleophilic group having an oxygen, sulfur or nitrogen atom enriched in electrons and bonded to the coupling position of Cp. E is an electrophilic group having a carbonyl group, a thiocarbonyl group, a phosphinyl group or a thiophosphinyl group and bonded to a hetero atom in Z. A defines a steric correlation between Nu and E, and it is a bonding group which is subject to an intramolecular nucleophilic reaction accompanied with formation of a three-membered ring to a seven-membered ring after Nu has been released from Cp and can release Z through said nucleophilic reaction.

Typical development inhibitors represented by Z may include mercaptotetrazole group, mercaptooxadiazole group, mercaptobenzothiazole group, mercaptothiadiazole group, mercaptobenzooxazole group, selenobenzooxazole group, mercaptobenzimidazole group, mercaptotriazole group, benzotriazole group, benzodiazole group and iodine atom, as disclosed in U.S. Pat. Nos. 3,227,554; 3,384,657; 3,615,506; 3,617,291; 3,733,201; and U.K. Pat. No. 1,450,479. Among them, mercaptotetrazole group, mercaptooxadiazole group, mercaptothiadiazole group, mercaptobenzooxazole group, mercaptobenzimidazole group, mercaptotriazole group, and benzotriazole group are preferred.

As the timing DIR compound to be used in the present invention, there may be included those as enumerated below, by which the present invention is not limited.

[T-1]
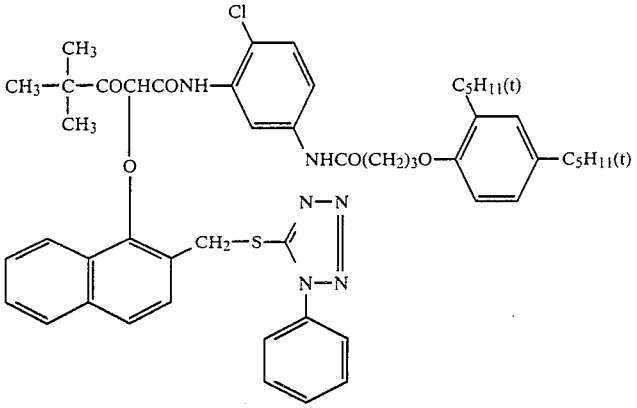
[T-2]
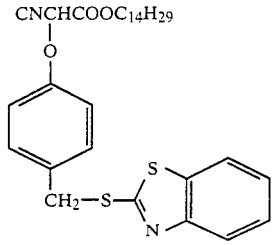
[T-3]
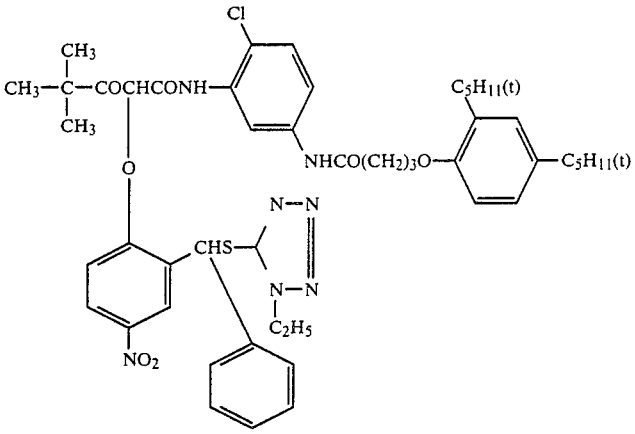
[T-4]
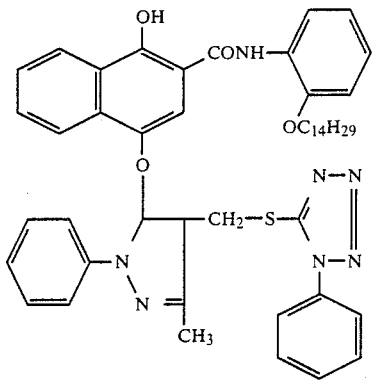
[T-5]
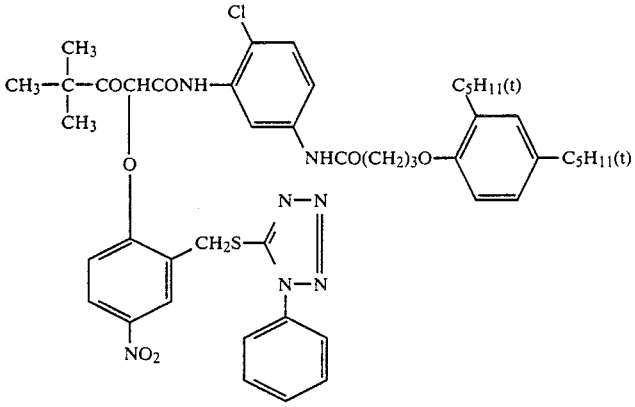
[T-6]
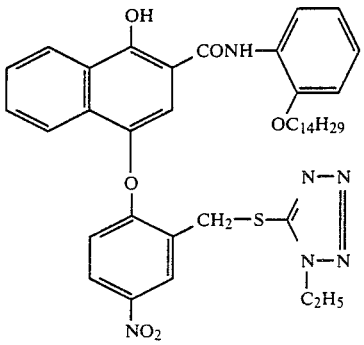
[T-7]
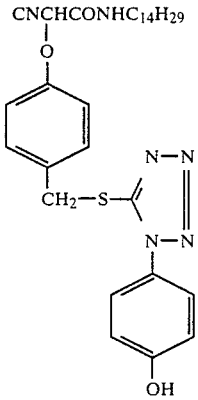
[T-8]
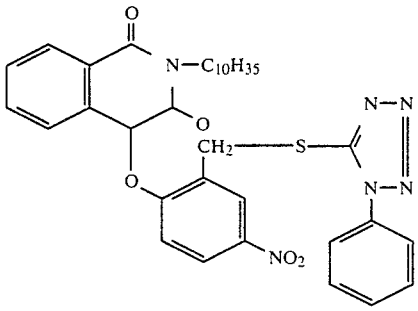

-continued
[T-9]
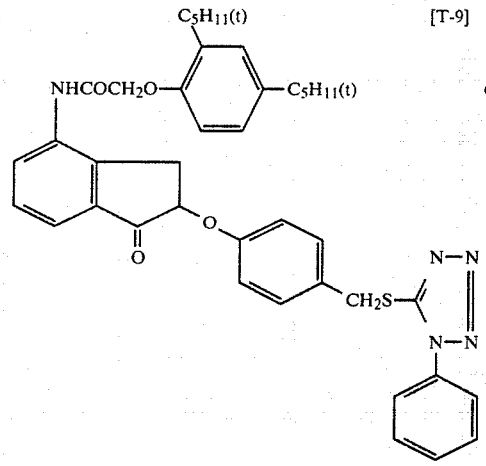
[T-10]
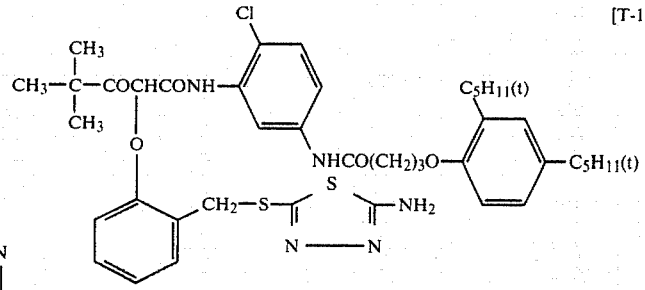
[T-11]
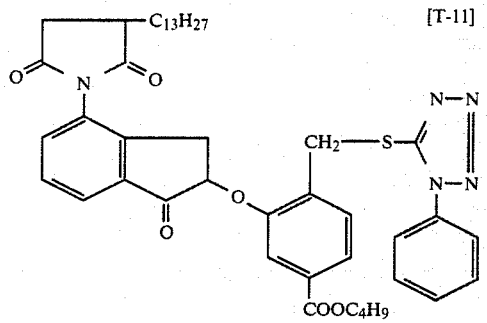
[T-12]
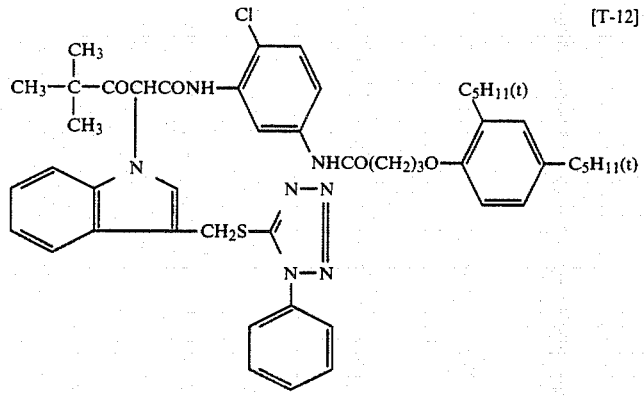
[T-13]
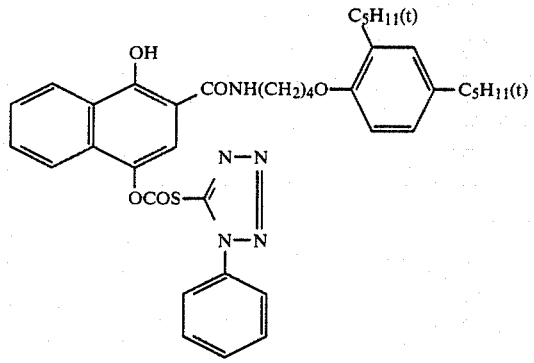
[T-14]
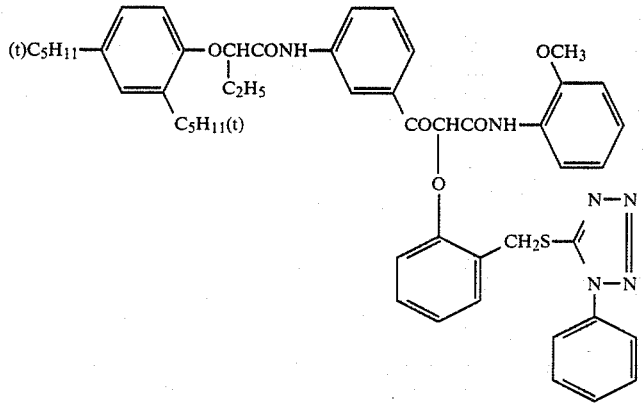

-continued
[T-15]
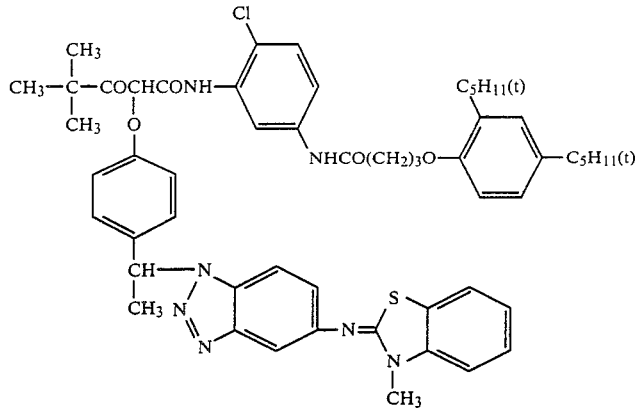
[T-16]
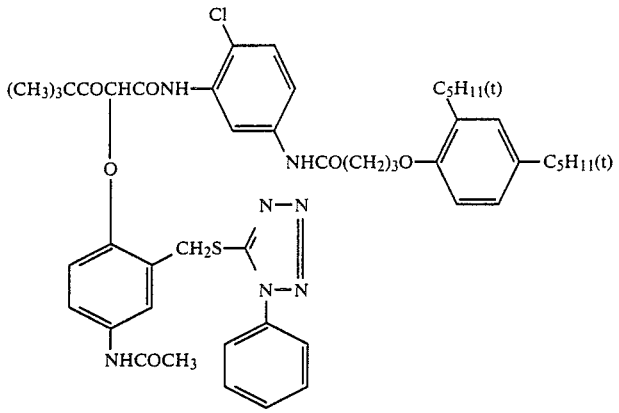
[T-17]
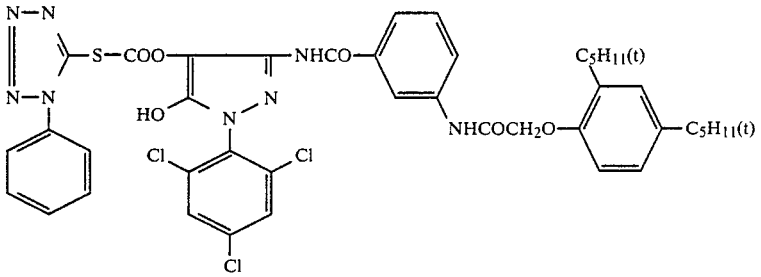
[T-18]
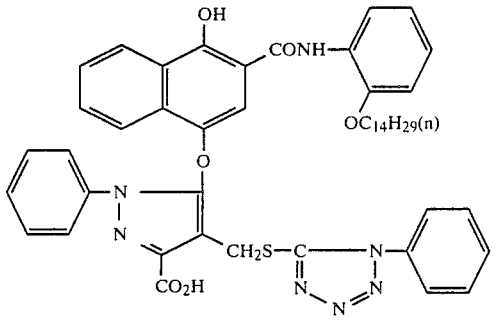

-continued
[T-19]
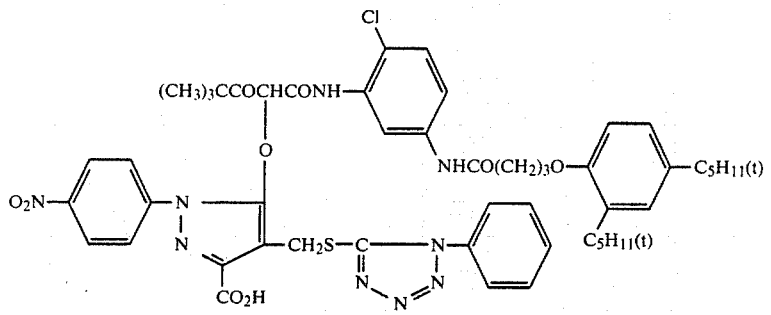
[T-20]
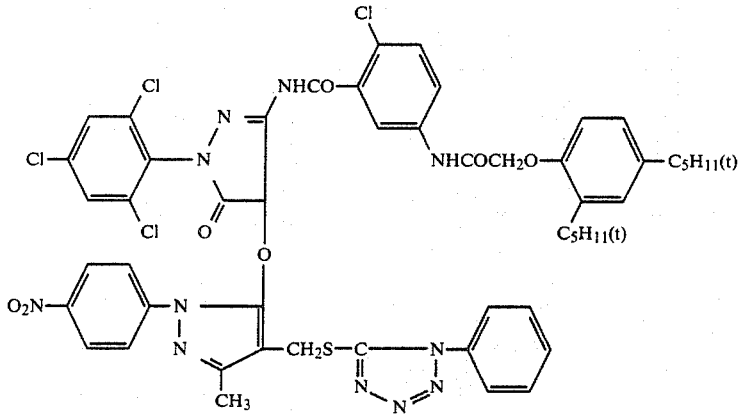
[T-21]
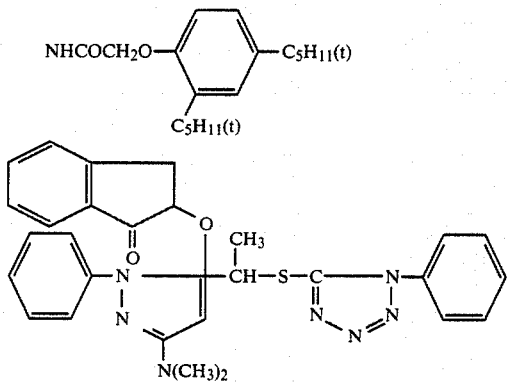
[T-22]
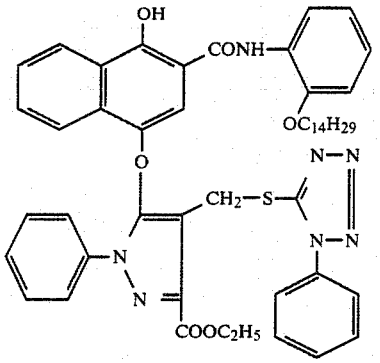
[T-23]
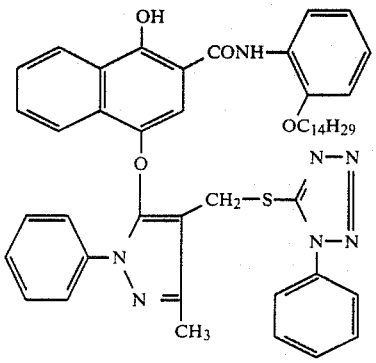
[T-24]
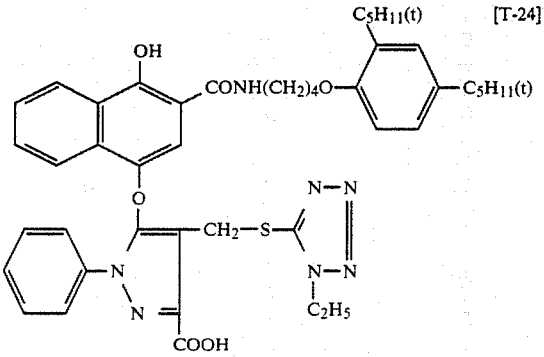

-continued
[T-25]
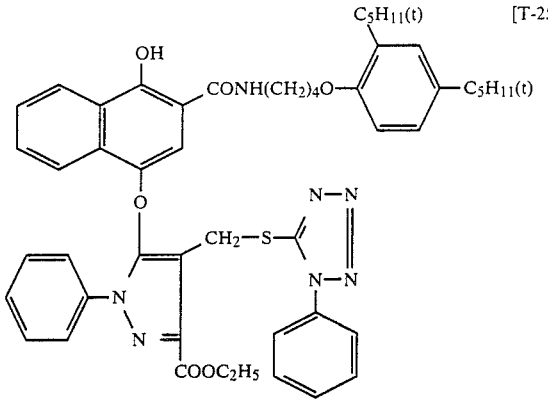
[T-26]
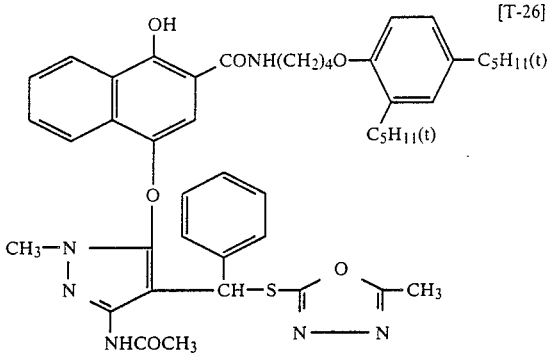
[T-27]
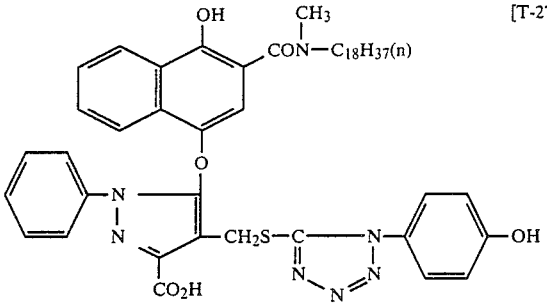
[T-28]
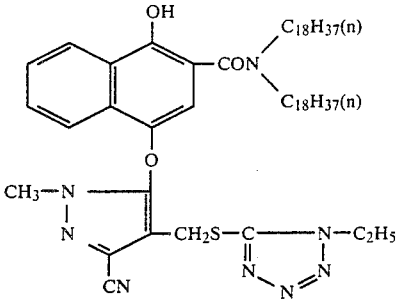
[T-29]
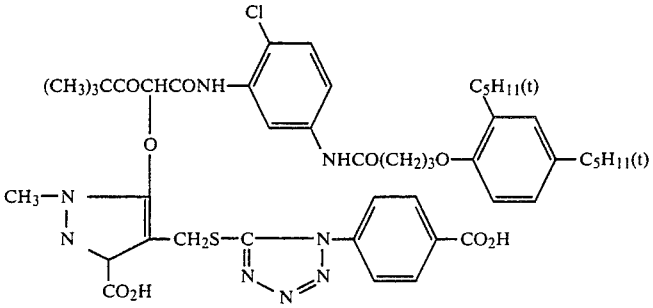
[T-30]
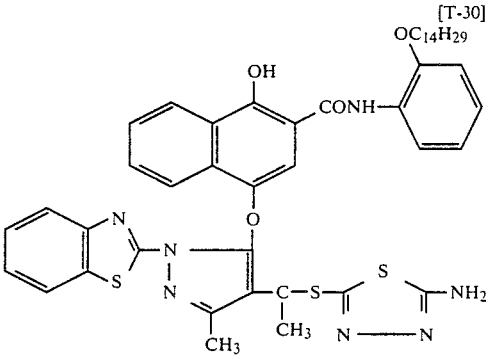
[T-31]
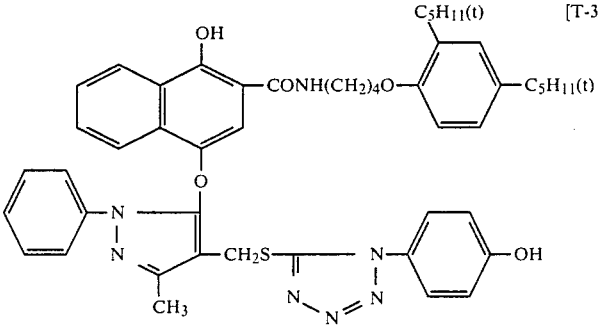

-continued
[T-32]
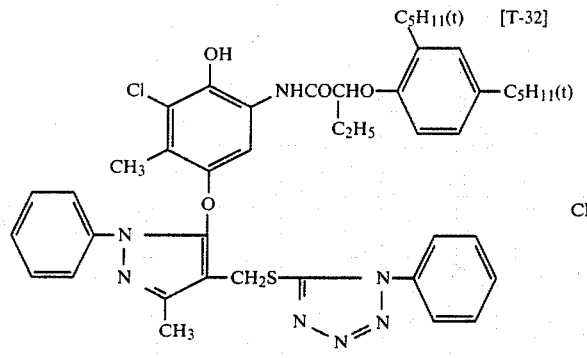
[T-33]
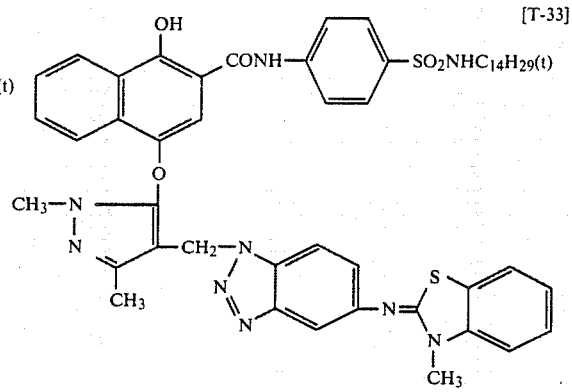
[T-34]
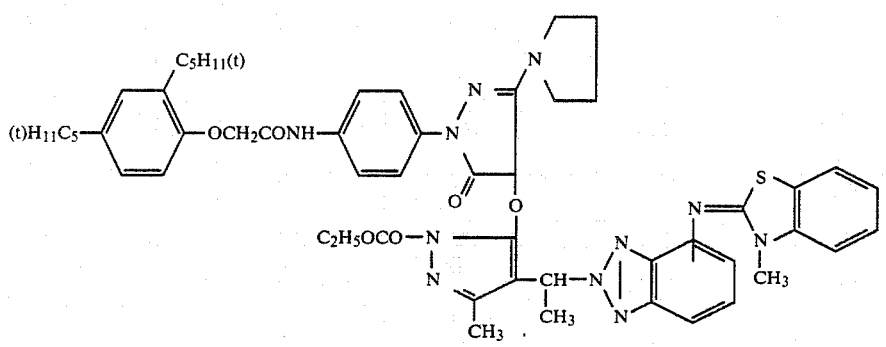
[T-35]
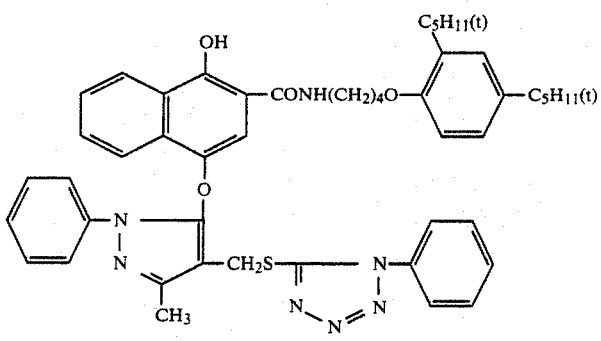
[T-36]
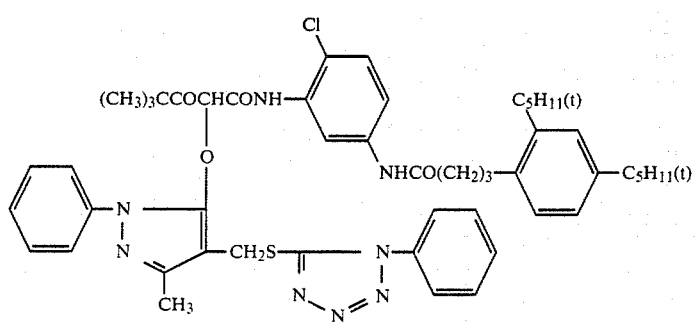

-continued
[T-37]
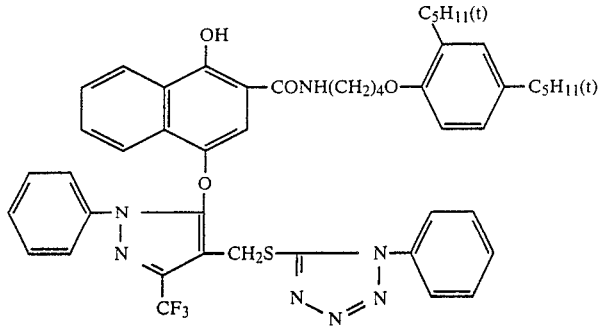
[T-38]
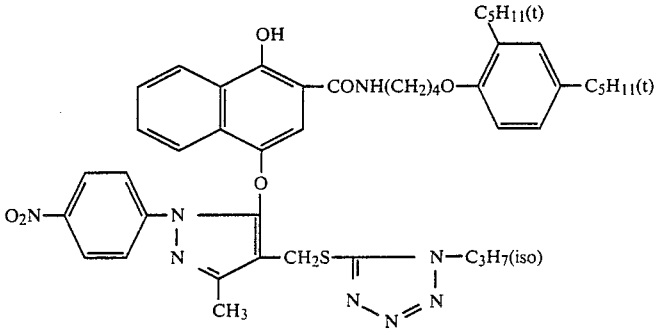
[T-39]
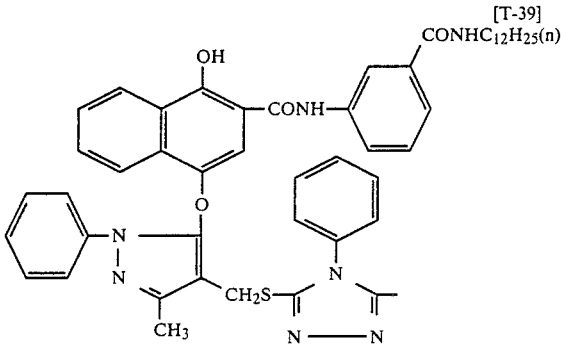
[T-40]
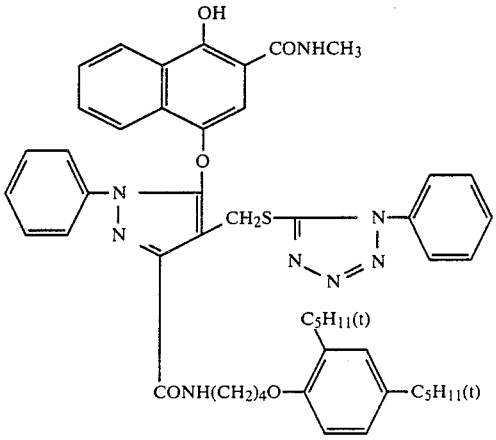
[T-41]
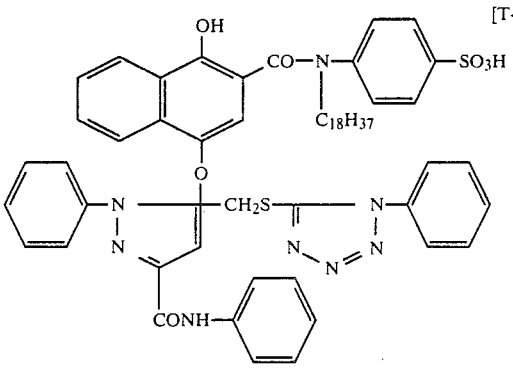
[T-42]
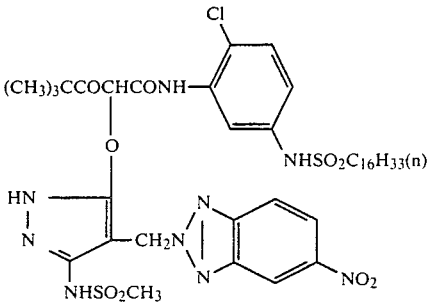

-continued
[T-43]
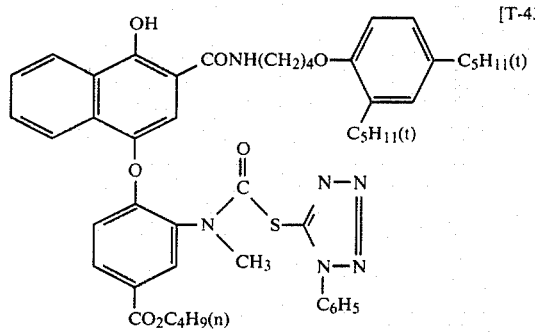
[T-44]
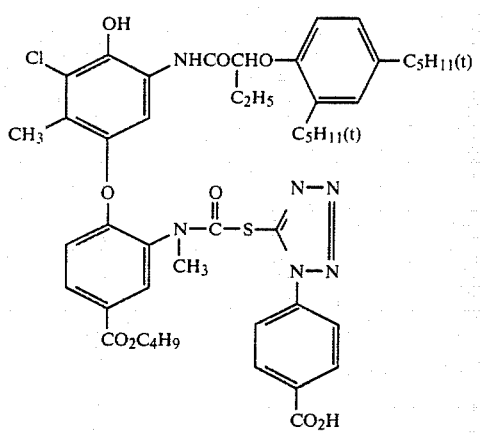
[T-45]
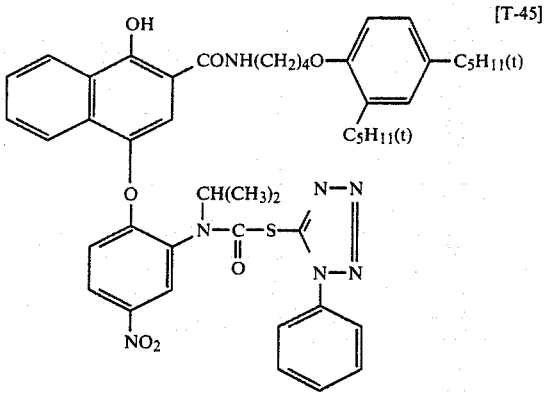
[T-46]
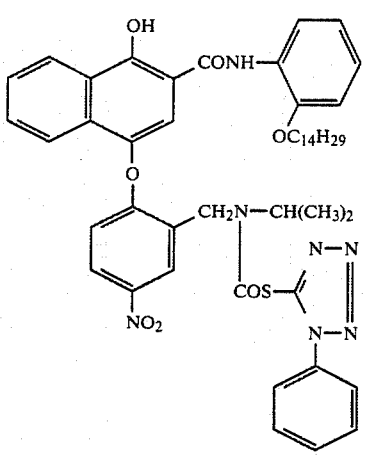
[T-47]
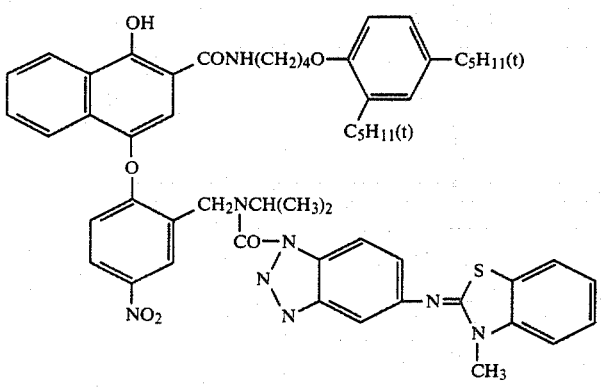
[T-48]~[T-55]
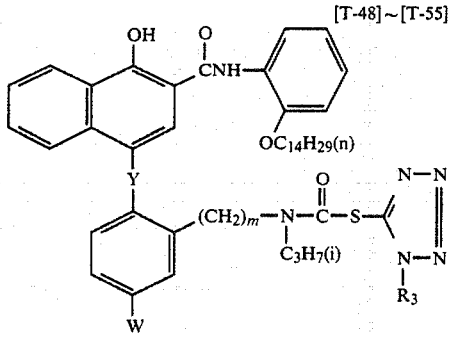
In the above formulae, Y, W, m and $R_3$ indicate the following:
| Comp. No | Y | W | m | $R_3$ |
|---|---|---|---|---|
| [T - 48] | O | $NO_2$ | 0 | 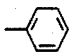 |
| [T - 49] | S | $NO_2$ | 1 | 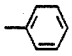 |
| [T - 50] | O | $NO_2$ | 1 | 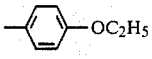 |
-continued
| | | | | |
|---|---|---|---|---|
| [T - 51] | O | $NO_2$ | 1 | 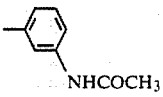 |
| [T - 52] | O | $NO_2$ | 1 | 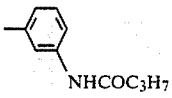 |
| [T - 53] | O | $COOC_4H_9$ | 0 | 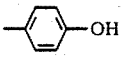 |

-continued
| | | | | |
|---|---|---|---|---|
| [T - 54] | O | $COOC_4H_9$ | 1 | 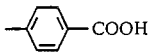 |
| [T - 55] | S | H | 0 | 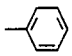 |
[T - 56]~[T - 60]
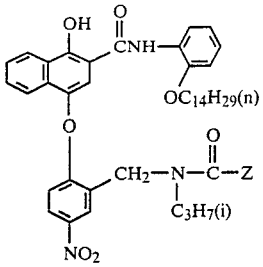
| Compound No. | Z |
|---|---|
| [T - 56] | Ethylmercaptotetrazole |
| [T - 57] | n-Butylmercaptotetrazole |
| [T - 58] | Cyclohexylmercaptotetrazole |
| [T - 59] | N—heptylmercaptotetrazole |
| [T - 60] | 5,6-Dicyclobenzotriazole |
[T - 61]
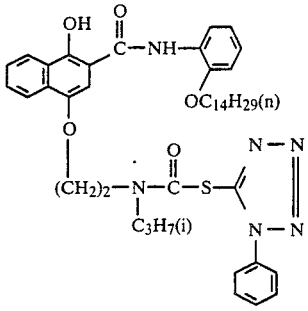
[T - 62]
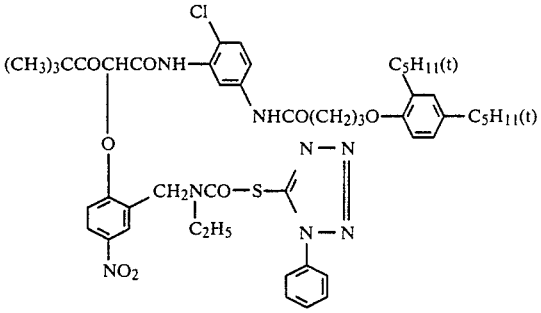
[T - 63]
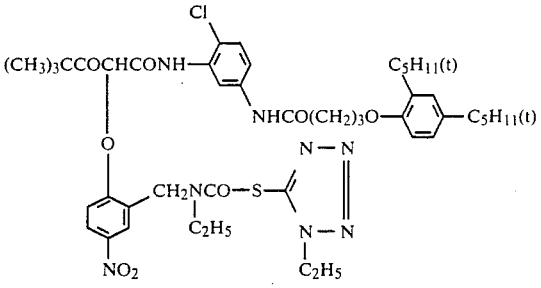
-continued
[T - 64]
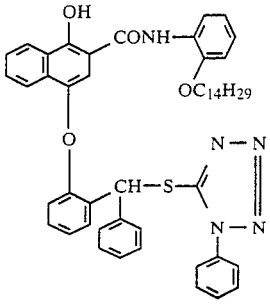
[T - 65]
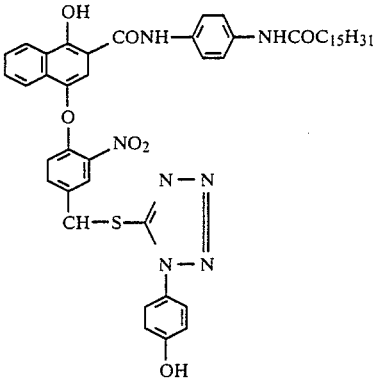
[T - 66]
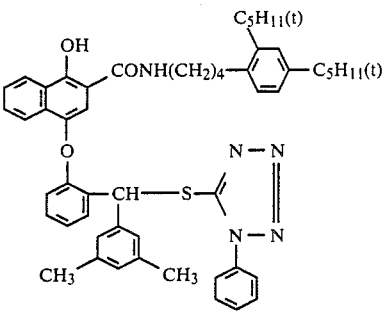
[T - 67]
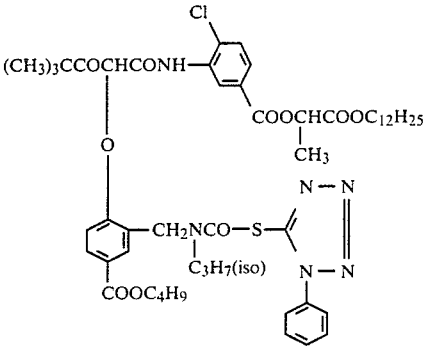
[T - 68]
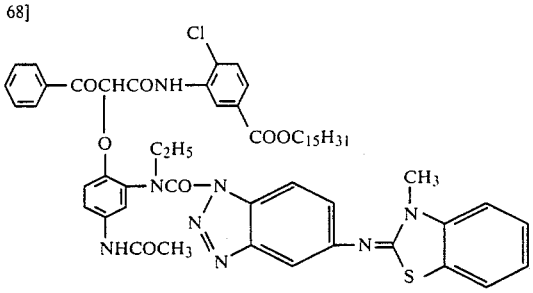

-continued

[T - 69]

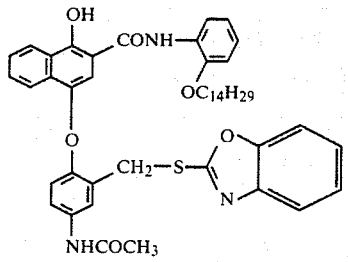

[T - 70]

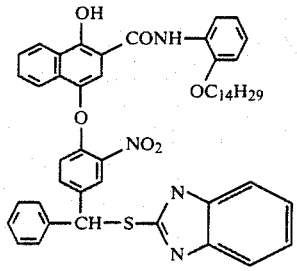

The timing DIR compounds of this invention can be synthesized according to the methods as described in the specification of Japanese Provisional Patent Publication Nos. 145135/1979, 114946/1981 and 154234/1982.

Next, the non-timing DIR compounds to be used in this invention are inclusive of the compounds represented by the formula [VII] shown below.

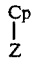

Formula [VII]

In the above formula [VII], Cp and Z have the same meanings as Cp and Z in the formula [II]. Further, as Cp, an oxazolinone type residue is also preferred.

The non-timing DIR preferred with respect to the effect of this invention is a compound of the formula [VII], wherein Z is shown by the formula [$Z_1$] or [$Z_2$] shown below.

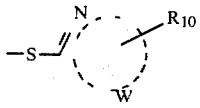

Formula [$Z_1$]

In the above formula [$Z_1$], W represents oxygen atoms, sulfur atoms, nitrogen atoms and carbon atoms necessary for formation of a five-membered heterocyclic ring, such as tetrazole ring, oxadiazole ring, thiadiazole ring, triazole ring, etc.; and $R_{10}$ represents a hydrogen atom, an alkyl group, an aryl group, an alkoxy group, an amino group or a heterocyclic group such as a furyl group.

Formula [$Z_2$]:

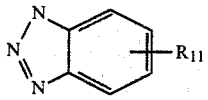

In the above formula [$Z_2$], $R_{11}$ represents benzothiazolinidene amino group.

The DIR compounds to be used in this invention are set forth below, but this invention is not limited thereby.

D - 1

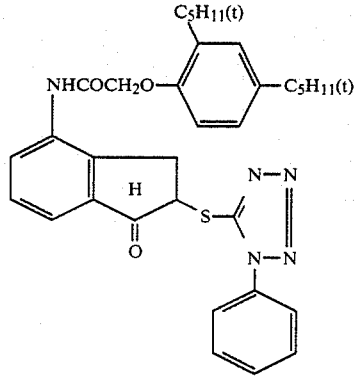

D - 2

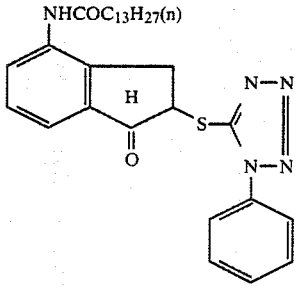

-continued
D - 3
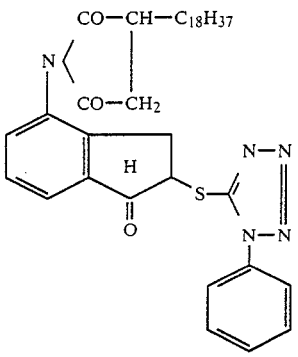
D - 4
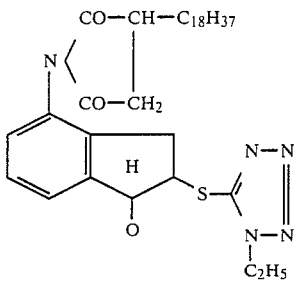
D - 5
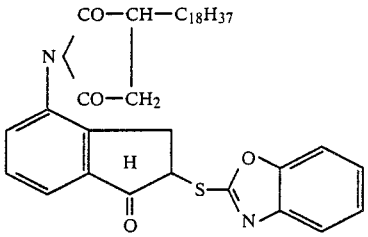
D - 6
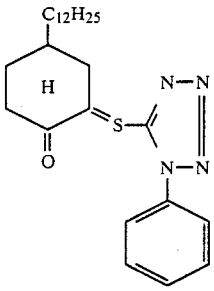
D - 7
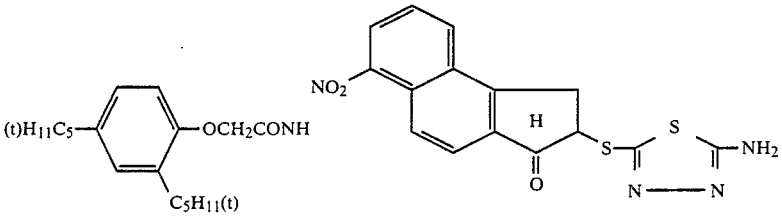
D - 8
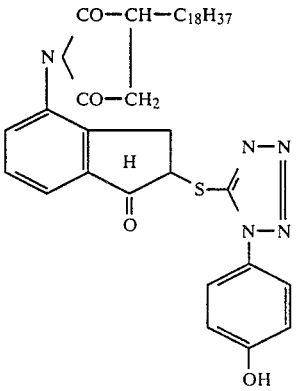
D - 9
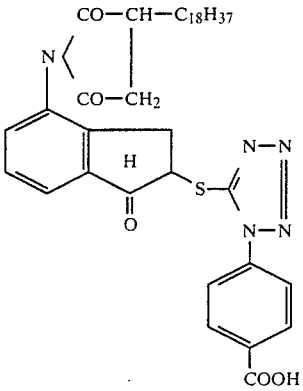

-continued
D - 10
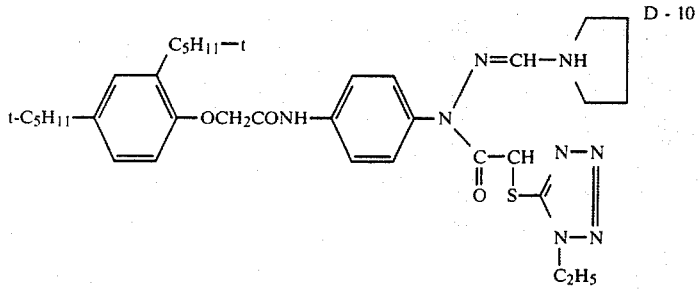
D - 11
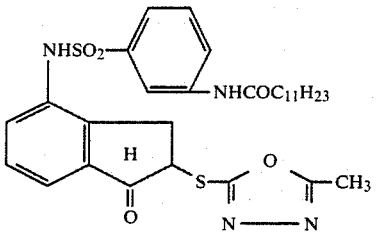
D - 12
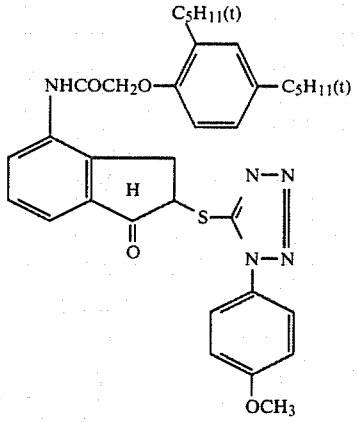
D - 13
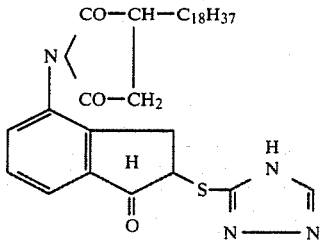
D - 14
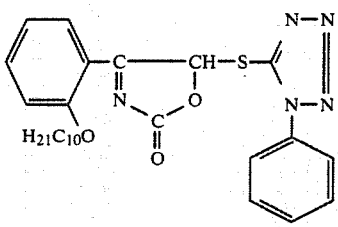
D - 15
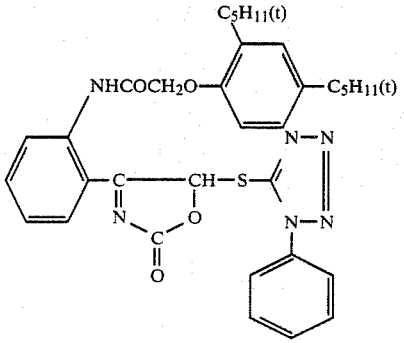
D - 16
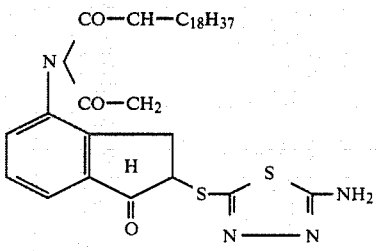

-continued
D - 17
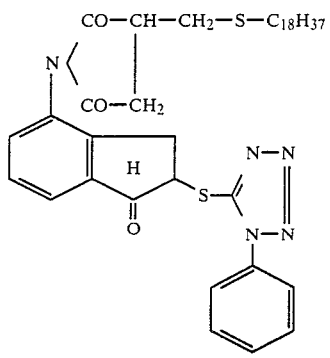
D - 18
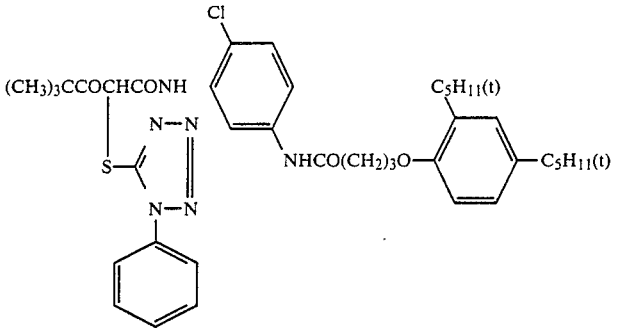
D - 19
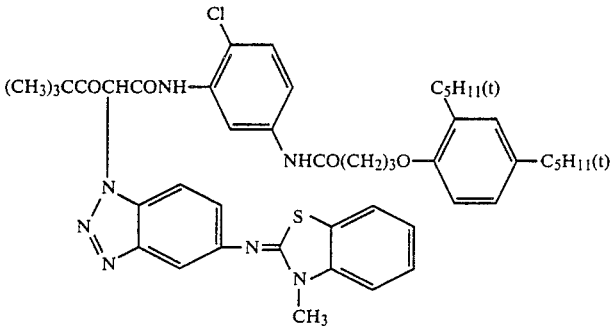
D - 20
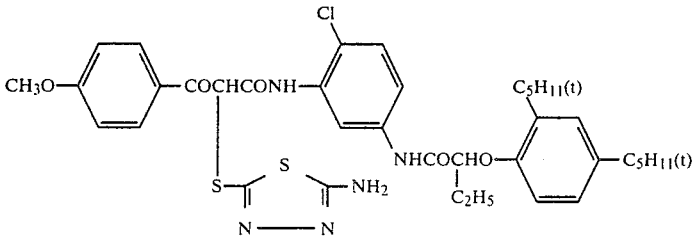

-continued
D - 21
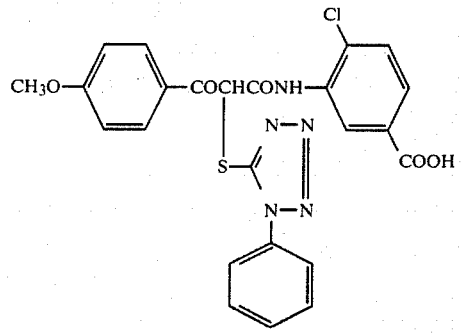
D - 22
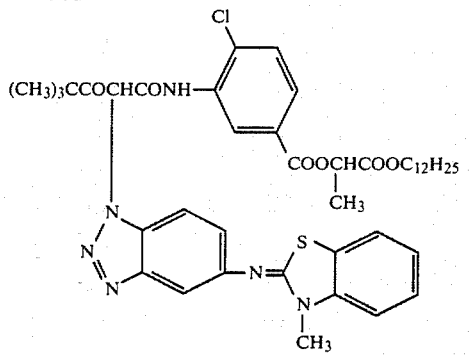
D - 23
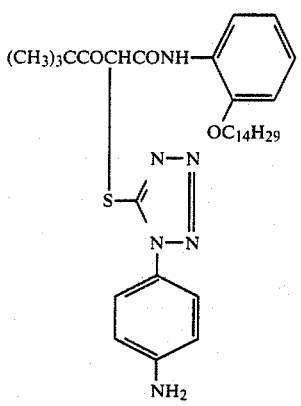
D - 24
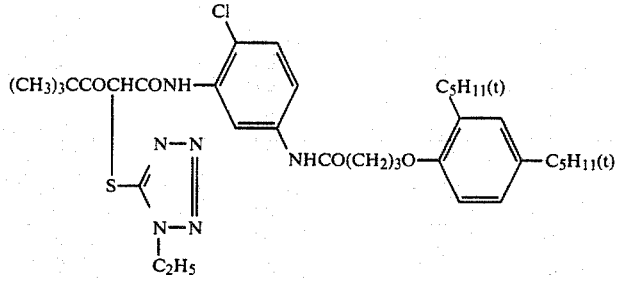
D - 25
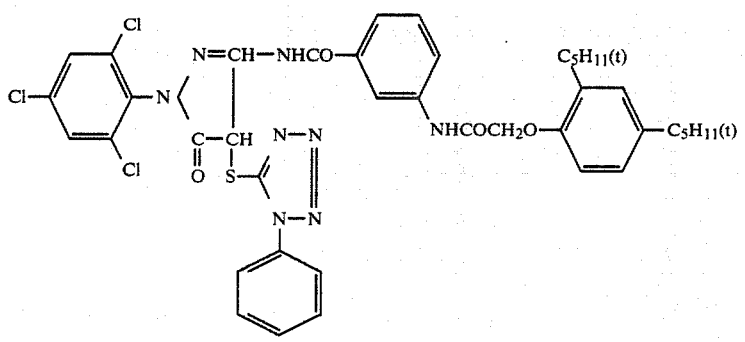
D - 26
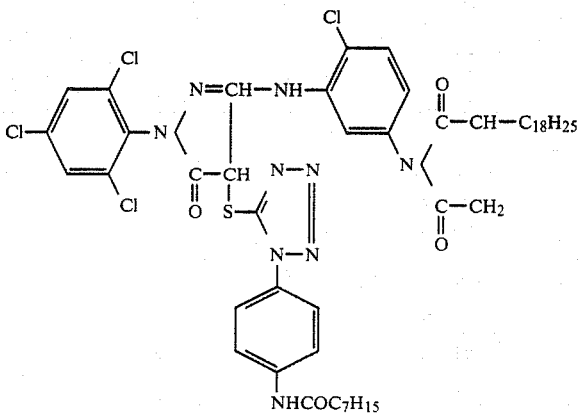

-continued
D - 27
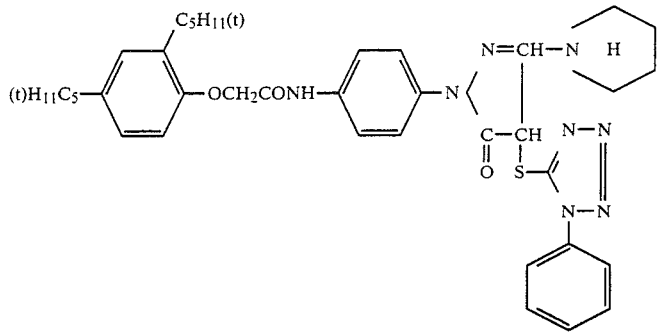
D - 28
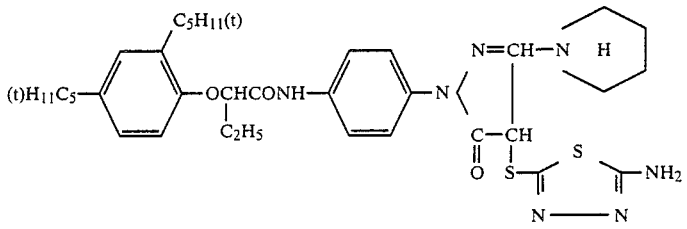
D - 29
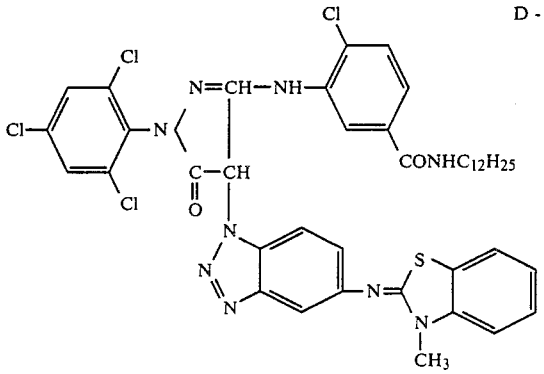
D - 30
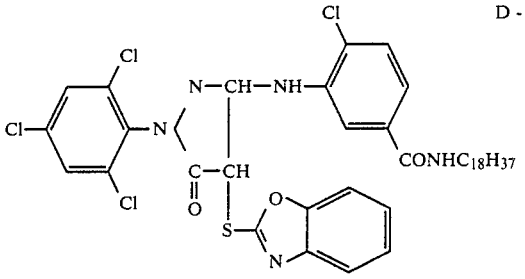
D - 31
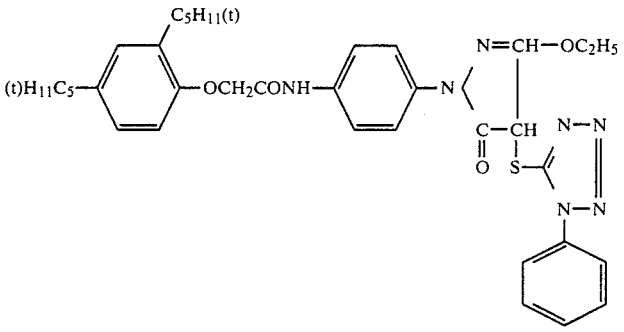

-continued
D - 32
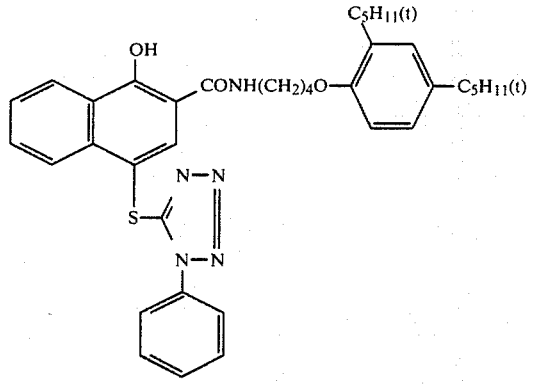
D - 33
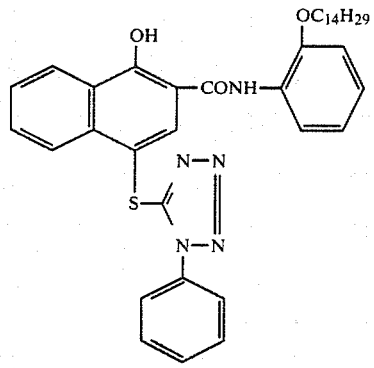
D - 34
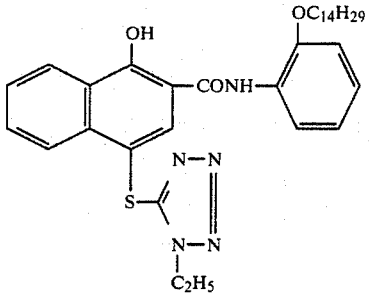
D - 35
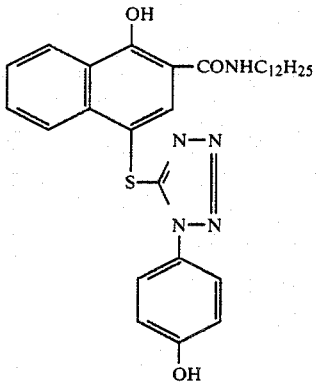
D - 36
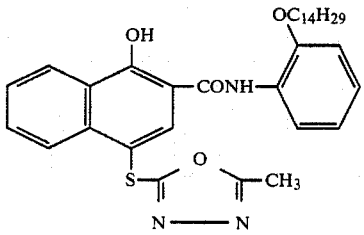
D - 37
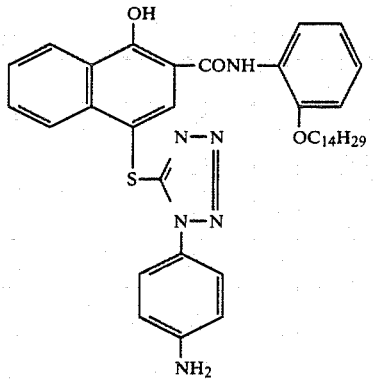
D - 38
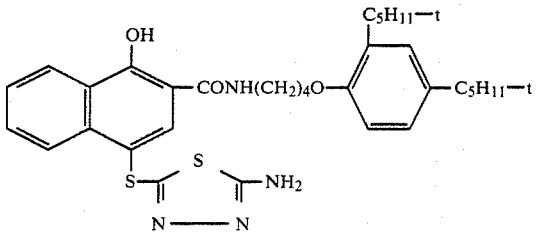
D - 39
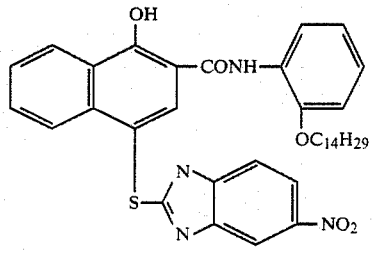
D - 40
D - 41

-continued

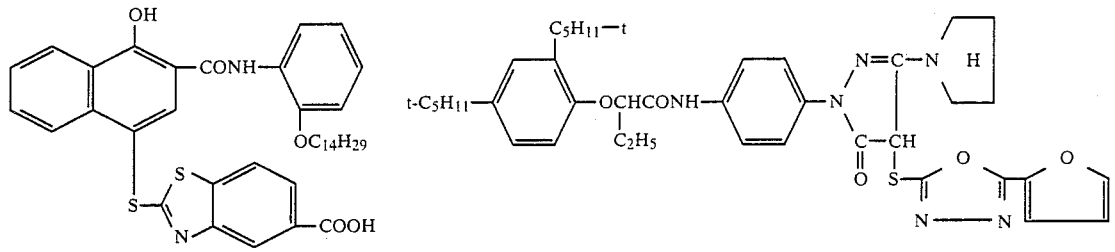

The DIR compounds of the general formula [VII] of this invention can be synthesized according to the methods as described in U.S. Pat. Nos. 3,148,062; 3,227,554; 3,701,783; 3,632,345; 3,928,041; Japanese Provisional Patent Publication Nos. 77635/1974, 104630/1974, 36125/1975, 82424/1977, 15273/1975 and 135835/1980.

In the light-sensitive material of this invention, the light-sensitive silver halide emulsion layer may comprise one or more of emulsion layer groups having the same light-sensitive wavelength region. When said silver halide emulsion layer comprises two or more emulsion layer, those emulsion layers may be contiguous to each other or they may be separated by another light-sensitive silver halide emulsion layer having a different light-sensitive wavelength region, an intermediate layer or other layers having different purposes.

As the non-light-sensitive hydrophilic colloidal layer according to this invention, there may be included an intermediate layer, an anti-halation layer, a yellow colloidal layer and a protective layer.

When the cyan coupler of this invention is to be added in a silver halide emulsion, it may be added in an amount in the range generally from 0.01 to 2 mole, preferably from 0.03 to 0.5 mole, per mole of silver halide.

When the timing type and/or non-timing type DIR compound of this invention is to be added in a silver halide emulsion layer, it may be added in an amount of 0.001 to 1 mole, preferably 0.005 to 0.5 mole, per mole of silver halide.

When the silver halide emulsion layer of this invention comprises two or more emulsion layers having the same color sensitivity, the cyan coupler of this invention may be incorporated in all the emulsion layers, or in some cases only in a specifically selected emulsion layer. As for the DIR compounds, they may be added in two or more emulsion layers having the same color sensitivity, or only in a specifically selected emulsion layer. They may also be incorporated in contiguous non-light-sensitive hydrophilic colloidal layers.

When the timing DIR compound and the non-timing DIR compound of this invention are used in combination, they may be used at any desired ratio, and, when the silver halide emulsion comprises two or more layers, they may be used in combination in the same layer, or added separately in different emulsion layers, respectively.

The cyan coupler of the formula [I], the DIR compounds of the formulae [II] and [VII] may be added as solutions or dispersions in high boiling point solvents similarly as the method as described in U.S. Pat. No. 2,322,027. Alternatively, they may also be added as alkaline aqueous solutions or solutions in hydrophilic organic solvents (methanol, ethanol, acetone, etc.).

The cyan coupler of this invention may be used in combination with a colorless coupler and may be added as the same emulsified product with such a coupler in a silver halide emulsion or as separate emulsified products independently of each other.

The cyan coupler and the DIR compounds according to this invention may be used in various kinds of light-sensitive silver halide photographic materials and useful for any of black-and white, color and false color photographic materials, and also applicable for light-sensitive silver halide color photographic materials in various uses such as black-and-white in general, black-and-white for printing, X-ray, electron beam, black-and-white for high resolution, color in general, color X-ray, diffusion transfer type color, etc.

For the multi-layer light-sensitive silver halide color photographic material of this invention, there may be employed two-equivalent or four-equivalent couplers known in the art. As the yellow coupler to be used in this invention, there may be employed an open-chain ketomethylene compound such as a pivalylacetamilide type or benzoylacetanilide type yellow coupler.

As the magenta coupler, there may be employed compounds of pyrazolone type, pyrazolotriazole type, pyrazolinobenzimidazole type, indazolone type and others.

As the cyan coupler, there may generally be employed a phenol or naphthol derivative.

Also, for improvement of photographic characteristics, there may be contained a coupler capable of forming a colorless coupler which is known as so called competing coupler.

As the coupler to be used in this invention, there may preferably be used a two-equivalent coupler as disclosed in Japanese Provisional Patent Publication No. 144727/1978, page 68–80, a four-equivalent coupler as disclosed in ibid., page 109–115.

In the emulsion layer or the non-light-sensitive colloidal layer containing the cyan coupler and the DIR compound of this invention, it is also possible to use in combination a reducing agent or an antioxidant, as exemplified by sulfites (sodium sulfite, potassium sulfite, etc.), bisulfites (sodium bisulfite, potassium bisulfite, etc.), hydroxylamines (hydroxylamine, N-methylhydroxylamine, N-phenylhydroxylamine, etc.), sulfinates (sodium phenylsulfinate), hydrazines (N,N'-dimethylhydrazine, etc.), reductones (ascorbic acid, etc.), aromatic hydrocarbons having one or more hydroxyl groups (e.g. p-aminophenol, alkyl hydroquinone, gallic acid, catechol, pyrogallol, resorcin, 2,3-dihydroxynaphthalene, etc.), and so on.

Further, for improvement of light fastness of the magenta color image formed from the magenta coupler according to this invention, there may be added p-alkoxyphenols or phenolic compounds in said emulsion layer or layers contiguous thereto.

The light-sensitive silver halide color photographic material of this invention may have a layer constitution according to conventional subtractive color process. In principle, the basic layer constitution comprises three layers of a blue sensitive layer containing a yellow coupler for forming a yellow dye therein, a green sensitive layer containing a magenta coupler for forming a magenta dye therein and a red sensitive layer containing a cyan coupler for forming a cyan dye therein. Further, any one or all of these respective layers may be made into a double or triple multi-layer structure for improvement of various photographic characteristics of the light-sensitive material such as color forming characteristic, color reproducibility, color forming dye graininess, etc.

In addition to these basic emulsion layers, there may suitably be employed a protective layer as the uppermost layer, intermediate layers or filter layers between layers, subbing layer or anti-halation layer as the lowest layer, for various purposes such as protection, prevention of color contamination, improvement of graininess, improvement of color reproduction, improvement of layer adhesion, etc.

As the silver halide to be used in the light-sensitive color photographic of this invention, there may be included any silver halide used in conventional silver halide photographic materials such as silver chloride, silver bromide, silver iodide, silver chlorobromide, silver iodobromide, silver chloroiodide, and the like.

The above silver halide emulsion can be sensitized with a known chemical sensitizer. As a chemical sensitizer, there may be employed a noble metal sensitizer, a sulfur sensitizer, a selenium sensitizer and a reducing sensitizer, either singly or in combination.

As the binder for silver halide, there may be employed known binders. Further, if necessary, the silver halide to be used in this invention can be spectrally sensitized with a known sensitizing dye.

In the above silver halide emulsions, for prevention of lowering in sensitivity or of generation of fog during manufacturing steps, storage or treatment of a light-sensitive color photographic material, there may be added various compounds such as heterocyclic compounds, including 1-phenyl-5-mercaptotetrazole, 3-methylbenzothiazole, 4-hydroxy-6-methyl-1,3,3a,7-tetrazaindene, etc., mercapto compounds, metallic salts, etc.

Film hardening treatment may be practiced also according to conventional procedures.

In the above silver halide emulsions, a surfactant may be added either singly or as a mixture. As the surfactant, there may be employed coating aids, emulsifiers, permeability enhancers for treating solutions, defoaming agents, antistatic agents, adhesion resistant agents, or various surfactants for improvement of photographic characteristics or physical properties.

The color developing agent to be used for treatment of the light-sensitive color photographic material of this invention is an alkaline aqueous solution containing a developing agent of pH 8 or more, preferably pH 9 to 12. The aromatic primary amine developing agent to be used as the developing agent means a compound having a primary amino group on an aromatic ring and capable of developing an exposed silver halide, or a precursor capable of forming such a compound.

Typical of the above developing agent are p-phenylenediamine type compounds, of which preferable examples are enumerated below.

Namely, there may be included 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethyl-4-amino-N,N-diethylaniline, 3-methoxy-4-amino-N-ethyl-N-β-methoxyethylaniline, 3-acetamide-4-amino-N,N-diethylaniline, 4-amino-N,N-dimethylaniline, N-ethyl-N-β-[β-(β-methoxyethoxy)ethoxy]ethyl-3-methyl-4-aminoaniline, N-ethyl-N-β-(β-methoxyethxy)ethyl-3-methyl-4-aminoaniline, salts thereof such as sulfates, hydrochlorides, sulfites, p-toluenesulfonic acid salts, etc. If necessary, it is also possible to add various additives to these color developing solutions.

The light-sensitive color photographic material of this invention, after imagewise exposure and color developing, may be subjected to a bleaching processing in a conventional manner. This processing may be conducted either simultaneously with or separately from fixing. The treating solution may be made into a bleaching-fixing bath by adding, if necessary, a fixing agent. As the bleaching agent, there may be employed various compounds, and various additives such as bleaching promoters may also be added therein.

This invention can be realized in various modes of light-sensitive color photographic materials. One of them is to treat a photographic material having a silver halide emulsion layer containing a diffusion resistant coupler on a support with an alkaline developing solution containing an aromatic primary amine type color developing agent, thereby permitting a water insoluble or diffusion resistant dye to be left in the emulsion layer. According to another mode, a light-sensitive photographic material having a silver halide emulsion layer in combination with a diffusion resistant coupler on a support is treated with an alkaline developing agent containing an aromatic primary amine type color developing agent to make it soluble in an aqueous medium, thereby forming a diffusive dye, which is in turn transferred onto an image receiving layer comprising another hydrophilic colloid. That is, this is the diffusion transfer color system.

The color light-sensitive material of this invention is inclusive of all kinds of color light-sensitive materials such as color negative films, color positive films, color reversal films, color papers, etc.

This invention is illustrated in more detail by referring to the following Examples, by which this invention is not limited at all.

EXAMPLE 1

The couplers of this invention as indicated in Table 1 and Control couplers (A), (B) and (C) were sampled in amounts of 10 mol %, respectively, based on Ag, and the non-timing DIR compounds as indicated in Table 1 were added to respective couplers, and each mixture was added to a mixed liquid of dibutyl phthalate in an amount of ½-fold of the coupler weight and ethyl acetate in an amount of three-fold of the coupler weight and completely mixed therein by heating to 60° C. Each solution was mixed with 200 ml of a 5% aqueous gelatin solution containing 20 ml of a 5% aqueous solution of Alkanol B (alkylnaphthalene sulfonate, produced by Du Pont de Nemours & Company), and emulsified in a colloid mill to obtain an emulsified product.

Then, each dispersion was added to 1 Kg of a silver iodobromide emulsion (containing 6% of silver iodide), followed by addition of 20 ml of a 2% solution of 1,2-bis-(vinylsulfonyl)ethane (water:methanol=1:1), and the resultant mixture was coated and dried on an undercoted transparent polyethyleneterephthalate base to prepare samples (1) to (12) (amount of silver coated: 20 mg/dm$^2$).

Control coupler (A):

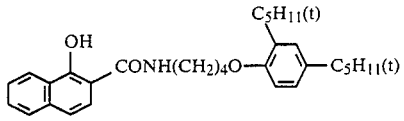

Control coupler (B):

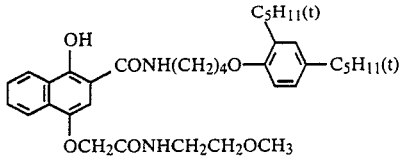

Control coupler (C):

(Compound as disclosed in Japanese Provisional Patent Publication No. 65134/1981)

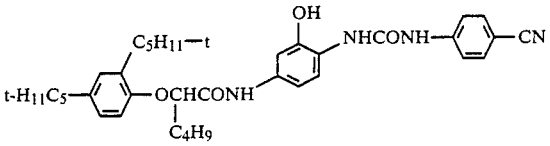

The thus prepared samples (1) to (12) were subjected to wedge exposure according to the conventional method, followed by the following developing treatments to obtain the results as shown in Table 1.

| [Processing] (38° C.) | Processing time |
|---|---|
| Color development | 3 minutes 15 seconds |
| Bleaching | 1 minute 30 seconds |
| Washing with water | 3 minutes 15 seconds |
| Fixing | 6 minutes 30 seconds |
| Washing with water | 3 minutes 15 seconds |
| Stabilization | 1 minute 15 seconds |

The following processing solutions were used in the processing steps:

| | |
|---|---|
| [Composition of color developing solution] | |
| 4-Amino-3-methyl-N—ethyl-N—(-hydroxyethyl)-aniline sulfate | 4.75 g |
| Anhydrous sodium sulfite | 4.25 g |
| Hydroxylamine half-sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Made up to 1 liter with water, and adjusted to pH 10.0 with potassium hydroxide. | |
| [Composition of bleaching solution] | |
| Ferric ammonium salt of ethylenediamine-tetraacetic acid | 100.0 g |
| Diammonium salt of ethylenediamine-tetraacetic acid | 10.0 g |
| Ammonium bromide | 150.0 g |
| Glacial acetic acid | 10.0 ml |
| Made up to 1 liter with water and adjusted to pH 6.0 with aqueous ammonia | |
| [Composition of fixing solution] | |
| Ammonium thiosulfate (50% aqueous solution | 162 ml |
| Anhydrous sodium sulfite | 12.4 g |
| Made up to 1 liter with water and adjusted to ph 6.5 with acetic acid | |
| [Composition of stabilizing solution] | |

-continued

| | |
|---|---|
| Formalin (37% aqueous solution) | 5.0 ml |
| Konidax (available from Konishiroky Photo Industry Co., Ltd.) | 7.2 ml |
| Made up to 1 liter with water. | |

The sensitivity values in Table 1 are indicated in terms of the relative values to the sensitivity of Sample-1 as 100.

TABLE 1

| Sample | Coupler | Non-timing DIR of Invention | Amount of DIR added (mol/Ag mol × 100) | S | $\gamma_2$ |
|---|---|---|---|---|---|
| 1 | Control A | D-33 | 0.5 | 100 | 0.58 |
| 2 | Control B | " | " | 125 | 0.74 |
| 3 | Control C | " | " | 115 | 0.65 |
| 4 | Invention 4 | " | " | 126 | 0.74 |
| 5 | Invention 11 | D-22 | " | 130 | 0.75 |
| 6 | Invention 19 | D-33 | " | 124 | 0.73 |
| 7 | Invention 22 | " | " | 134 | 0.77 |
| 8 | Invention 26 | " | " | 130 | 0.76 |
| 9 | Invention 29 | " | " | 128 | 0.74 |
| 10 | Invention 30 | D-3 | " | 129 | 0.74 |
| 11 | Invention 42 | D-4 | 0.6 | 126 | 0.73 |
| 12 | Invention 47 | " | 0.6 | 128 | 0.75 |

From Table 1, it can be seen that the sample employing Control coupler (A) or (C) in combination with the non-timing DIR compound of this invention is bad in gradation characteristic, while the sample employing Control coupler (B) or the cyan coupler of this invention in combination with the non-timing DIR compound of this invention is good in gradation characteristic and also high in sensitivity.

EXAMPLE 2

Each of the couplers of this invention as indicated in Table 2 and Control couplers (A) and (C) was sampled in an amount of 10 mol % based on Ag, and to each coupler was added the non-timing DIR compound of this invention, followed by addition of a mixed solution of dibutyl phthalate in an amount of half of the coupler weight and ethyl acetate in an amount of three times the coupler weight. After the mixture was emulsified, the emulsified product was stored in a refrigerator overnight. Stability of each dispersion was examined on a preparation by means of an optical microscope.

TABLE 2

| Sample | Coupler | DIR of Invention | Amount of DIR added (mol/Ag mol × 100) | Precipitation |
|---|---|---|---|---|
| 13 | Control A | D-1 | 0.5 | None |
| 14 | Control C | D-32 | " | " |
| 15 | Invention 7 | D-1 | | " |
| 16 | Invention 21 | D-32 | " | " |
| 17 | Invention 23 | " | " | " |
| 18 | Invention 41 | " | " | " |
| 19 | Invention 43 | " | " | " |
| 20 | Invention 44 | " | " | " |

From Table 2, it can be seen that precipitation is observed in the sample in which Control coupler (C) and the non-timing DIR compound of this invention are employed in combination, while the samples according to this invention are found to be good.

EXAMPLE 3

Each of Control couplers (B), (D), (E) and the couplers of this invention was sampled in the amount as indicated in TAble 3, and to each coupler was added the non-timing DIR compound as indicated in Table 3. Each mixture was added to a mixed solution of dibutyl phthalate in an amount of half of the coupler weight and ethyl acetate in an amount of three times the coupler weight to be dissolved therein, followed by emulsification under the same conditions as in Example 1 to obtain an emulsified product.

Then, each of the resultant dispersion was added to 1 Kg of a red sensitive silver iodobromide emulsion (containing 8 mol % of silver iodide) and, with addition of a film hardener similarly as in Example 1, coated and dried on an undercoated transparent polyethyleneterephthalate base to prepare samples (21) to (25).

Control coupler (D):

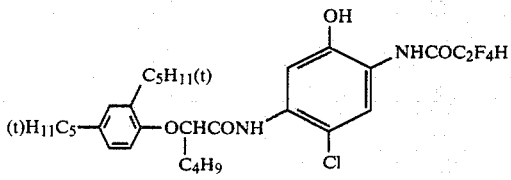

Control coupler (E):

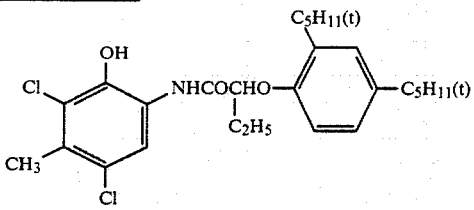

The thus obtained samples 21 to 25 were subjected to wedge exposure, followed by developing treatment similarly as in Example 1, and graininess of the color image of each sample was measured with a red light according to the RMS (Root mean square) method. The results of RMS graininess at the density of 0.7 are given in Table 3.

On the other hand, the samples were exposed to light through wedges with space frequencies varying in the range from 3 lines/mm to 100 lines/mm, subjected to developing treatment in the same manner as in Example 1, and MTF (Modulation Transfer Function) of the obtained color image was determined with a red light. By comparison between the values of MTF at space frequencies of 10 lines/mm and 30 lines/mm, improved effects of sharpness were examined to obtain the results as shown in Table 3.

RMS values are shown as 1000-fold values of the standard deviations of fluctuations in density values which occur during scanning by means of a microdensitometer with a circular scanning orifice diameter of 25μ.

MTF values were determined by conducting density measurements by means of a slitter with a slit width of 300μ in longitudinal direction and 2μ in lateral direction and calculating percentages of resolving powers relative to inputs therefrom.

The wavelengths at the maximum absorptions of the color developed dyes were determined for the samples obtained by the aforesaid ordinary developing processing by means of a spectrophotometer (Type 320 produced by Hitachi Co.) to obtain the results as shown in Table 3.

TABLE 3

| Sample | Coupler | Amount* of coupler | DIR compound of Invention | Amount* of DIR added | Amount of Ag coated (mg/dm$^2$) | Gamma | RMS | MTF 10 line/mm | MTF 30 line/mm | λ-max |
|---|---|---|---|---|---|---|---|---|---|---|
| 21 | Control coupler B | 10 | D-34 | 0.7 | 20 | 0.75 | 40 | 110 | 83 | 695 |
| 22 | Control coupler D | 15 | D-34 | 0.7 | 20 | 0.75 | 41 | 103 | 75 | 670 |
| 23 | Control coupler E | 10 | D-34 | 0.7 | 20 | 0.80 | 36 | 113 | 85 | 665 |
| 24 | Coupler of Invention 32 | 10 | D-34 | 0.7 | 20 | 0.78 | 32 | 115 | 85 | 693 |
| 25 | Coupler of Invention 32 | 10 | D-4 | 0.7 | 20 | 0.75 | 33 | 114 | 90 | 694 |

*Amounts of coupler and DIR added: compound mol/Ag mol × 100

Table 3 shows that the sample eploying Control (D) becomes bad in graininess and sharpness by increase of the amount of coupler, and the sample employing Control coupler (E) exhibits a short wavelength of λ-max which is not favorable with respect to color reproduction.

On the other hand, Control coupler (B) is bad in graininess. In contrast, the samples according to this invention are good both in graininess and sharpness, and exhibit favorably long wavelengths of λ-max.

EXAMPLE 4

After the samples (21) to (25) obtained in Example 3 were exposed in a conventional manner, the following development processings were carried out and reductive color fading tendencies of cyan dyes were examined. For examination, dye residual percentages were determined. Evaluation was conducted according to the method, in which density measurement was carried out after development processing, then after immersing in a 5% red prussiate solution (pH=6.5) followed by washing with water and drying, density measurement was again carried out. The reductive fading tendency was calculated as a residual percentage of dye by the following formula:

$$\text{Dye residual } \% = \frac{Dm \text{ after ordinary processing}}{Dm \text{ after red prussiate processing}} \times 100$$

As the next step, Dmax portions of samples obtained after the above ordinary treatment were subjected to measurement of Ag contents by the fluorescent X-ray analysis for examination of Ag removal characteristic.

| [Processing steps] (38° C.) | Processing time |
|---|---|
| Color development | 3 minutes 15 seconds |
| Bleach-fixing | 6 minutes 30 seconds |
| Washing with water | 2 minutes 00 seconds |

The processing solutions employed in the processing steps had the following compositions.

| | |
|---|---|
| [Composition of color developing solution] | |
| 4-Amino-3-methyl-N—ethyl-N—(β-hydroxyethyl)-aniline sulfate | 4.75 g |
| Anhydrous sodium sulfite | 4.25 g |
| Hydroxylamine half-sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Made up to 1 liter with water, and adjusted to pH 10.0 with potassium hydroxide. | |
| [Composition of bleach-fixing solution] | |
| Ferric ammonium salt of ethylenediamine-tetraacetic acid | 50 g |
| Ammonium sulfite (40% solution) | 50 ml |
| Ammonium thiosulfate (70% solution) | 140 ml |
| Ammonia water (28% solution) | 20 ml |
| Ethylenediaminetetraacetic acid | 4 g |
| Made up to 1 liter with water. | |

TABLE 4

| Sample | Residual dye percentage (%) | Residual Ag (mg/dm$^2$) |
|---|---|---|
| 21 | 77 | 0 |
| 22 | 99 | 0 |
| 23 | 74 | 0 |
| 24 | 99 | 0 |
| 25 | 99 | 0 |

From Table 4, it can be seen that color fading of cyan dye occurs in samples employing Control couplers (B) and (E), while the samples of this invention are good.

EXAMPLE 5

On supports comprising a transparent polyethyleneterephthalate, there were provided respective layers shown below consecutively from the side of the support to prepare multi-layer color nega light-sensitive materials [Sample Nos. (26)–(30)].

First layer: Halation preventive layer

An aqueous gelatin solution containing black colloidal silver was coated at 0.3 g of silver/m$^2$ to a dried film thickness of 3.0μ.

Second layer: Intermediate layer

An aqueous gelatin solution was coated to a dried film thickness of 1.0μ.

Third layer: Low sensitivity red sensitive silver halide emulsion layer

A silver iodobromide emulsion (prepared by mixing a silver iodobromide emulsion with a mean grain size of 0.6μ containing 4 mol % of silver iodide and a silver iodobromide with a mean grain size of 0.3μ containing 4 mol % of silver iodide at a ratio of 2:1) was chemically sensitized with gold and sulfur sensitizers, and further mixed with, as red sensitive sensitizing dyes, anhydrous 9-ethyl-3,3'-di-(3-sulfopropyl)-4,5,4',5'-dibenzothiacarbocanine hydroxide; anhydrous 5,5-dichloro-9-ethyl-3,3'-di(3-sulfobutyl)thiacarbocyanine hydroxide; and anhydrous 2-[2-{(5-chloro-3-ethyl-2(3H)benzothizolildene)methyl}-1-butenyl-5-chloro-3-(4-sulfobutyl)bnzooxazolium, followed by addition of 1.0 g of 4-hydroxy-6-methyl-1,3,3a,7-tetrazaindene and 20.0 ml of 1-phenyl-5-mecraptotetrazole to prepare a low sensitivity red sensitive emulsion.

There were employed 0.15 mol of a cyan coupler, 0.01 mol of colored cyan coupler and a DIR compound in combinations as indicated in Table 5 per mol of silver halide. Further, 0.5 g of dodecyl gallate was added and dissolved under heating in a mixture of 65 g of dibutyl phthalate and 136 ml of ethyl acetate, and the resultant solution added into 550 ml of a 7.5% aqueous gelatin solution containing 5 g of sodium triisopropylnaphthalene sulfonate, followed by emulsification in a colloid mill. The resultant dispersion was added to the above emulsion to prepare a low sensitivity red sensitive emulsion and coated to a dried film thickness of 4.0μ (containing 160 g of gelatin per mole of silver halide).

Fourth layer: High sensitivity red sensitive silver halide emulsion layer

A silver iodobromide emulsion (mean grain size of 1.2μ, containing 7 mol % of silver iodide) was chemically sensitized with gold and sulfur sensitizers, and further mixed with, as red sensitive sensitizing dyes, anhydrous 9-ethyl-3,3'-di-(3-sulfopropyl)-4,5,4',5'-dibenzothiacarbocanine hydroxide; anhydrous 5,5'-dichloro-9-ethyl-3,3'-di(3-sulfobutyl)thiacarbocyanine hydroxide; and anhydrous 2-[2-{(5-chloro-3-ethyl-2(3H)-benzothizolildene)methyl}-1-butenyl-5-chloro-3-(4-sulfobutyl)]bnzooxazolium, followed by addition of 1.0 g of 4-hydroxy-6-methyl-1,3,3a,7-tetrazaindene and 10.0 g of 1-phenyl-5-mecraptotetrazole to prepare a high sensitivity red sensitive emulsion.

There were employed 0.15 mol of a cyan coupler, 0.01 mol of colored cyan coupler and a DIR compound in combinations as indicted in Table 5 per mol of silver halide.

Further, 0.5 g of dodecyl gallate and 0.5 g of 2,5-di-tert-octylhydroquinone were added and dissolved under heating in a mixture of 20 g of dibutyl phthalate and 60 ml of ethyl acetate, and the resultant solution added into 30 ml of a 7.5% aqueous gelatin solution containing 1.5 g of sodium triisopropylnaphthalene sulfonate, followed by emulsification in a colloid mill. The resultant dispersion was added to the above emulsion to prepare a low sensitivity red sensitive emulsion and coated to a dried film thickness of 2.0μ (containing 160 g of gelatin per mol of silver halide).

Fifth layer: Intermediate layer

The same as the second layer.

Sixth layer: Low sensitivity green sensitive silver halide emulsion layer

A silver iodobromide emulsion with a mean grain size of 0.6μ containing 4 mol % of silver iodide and a silver iodobromide emulsion with a mean grain size of 0.3μ containing 7 mol % of silver iodide were each chemically sensitized with gold and sulfur sensitizers, and further mixed with, as green sensitive sensitizing dyes, anhydrous 5,5'-dichloro-9-ethyl-3,3'-di-(3-sulfobutyl-)oxacarbocyanine hydroxide; anhydrous 5,5'-diphenyl-9-ethyl-3,3-di-(sulfobutyl)oxacarboxyanine hydroxide; and anhydrous 9-ethyl-3,3-di-(3-sulfopropyl)-5,6,5',6'-dibenzooxacarbocyanine hydroxide, followed by addition of 1.0 g of 4-hydroxy-6-methyl-1,3,3a-7-tetrazaindene and 20.0 mg of 1-phenyl-5-mercaptotetrazole. The thus obtained two kinds of silver halide emulsions were mixed at a ratio of 1:1 to prepare a low sensitivity green sensitive silver halide emulsion.

Further, per mol of silver halide, there were added as a magenta coupler 100 g of 1-(2,4,6-trichlorophenyl)-3-{3-(4-dodecyloxphenyl)sulfonamidobenzamido}-pyrazolin-5-one, as a DIR compound 1.6 g of 2-(1-phenyl-5-tetrazolylthio)-4-octadecylsuccinimide-1-indanone, and as a colored magenta coupler 2.5 g of 1-(2,4,6-trichlorophenyl)-4-(1-naphthylazo)-3-(2-chloro-5-octadecenylsuccinimidoanilino)-5-pyrazolone, further 0.5 g of dodecyl gallate and dissolved under heating in a mixture of 120 g of tricresyl phosphate and 240 ml, and the resultant solution added into an aqueous gelatin solution containing sodium triisopropylnaphthalene sulfonate, followed by emulsification in a colloid mill. The resultant dispersion was mixed with the above emulsion to prepare a low sensitivity green sensitive emulsion, which was coated to a dried film thickness of 4.0μ (containing 160 g of gelatin per mole of silver halide).

Seventh layer: High sensitivity green sensitive silver halide emulsion layer

A silver iodobromide emulsion with a mean grain size of 1.6μ containing 7 mol % of silver iodide was chemically sensitized with gold and sulfur sensitizers, and further mixed with, as green sensitive sensitizing dyes, anhydrous 5,5'-dichloro-9-ethyl-3,3'-di-(3-sulfobutyl-)oxacarbocyanine hydroxide; anhydrous 5,5'-diphenyl-9-ethyl-3,3'-di-(sulfobutyl)oxacarboxyanine hydroxide; and anhydrous 9-ethyl-3,3'-di-(3-sulfopropyl)-5,6,5',6'-dibenzooxacarbocyanine hydroxide, followed by addition of 1.0 g of 4-hydroxy-6-methyl-1,3,3a-7-tetrazaindene and 10.0 mg of 1-phenyl-5-mercaptotetrazole to prepare a high sensitivity green sensitive silver halide emulsion.

Further, per mol of silver halide, there were added as a magenta coupler 80 g of 1-(2,4,6-trichlorophenyl)-3-{3-(2,4-tert-amylphenoxyacetamido)benzamido}-pyrazolin-5-one, as a DIR compound 2.5 g of 2-(1-phenyl-5-tetrazolylthio)-4-octadecylsuccinimide-1-indanone, and as a colored magenta coupler 2.5 g of 1-(2,4,6-trichlorophenyl)-4-(1-naphthylazo)-3-(2-chloro-5-octadecenylsuccinimidoanilino)-5-pyrazolone and 15 g of 2,5-di-t-octylhydroquinone, respectively, and dissolved under heating in a mixture of 120 g of tricresyl phosphate and 240 ml, and the resultant solution added into an aqueous gelatin solution containing sodium triisopropylnaphthalene sulfonate, followed by emulsification in a colloid mill. The resultant dispersion was mixed with the above emulsion to prepare a high sensitivity green sensitive emulsion, which was coated to a dried film thickness of 2.0μ (containing 160 g of gelatin per mole of silver halide).

Eighth layer: Intermediate layer

The same as the second layer.

Ninth layer: Yellow filter layer

In an aqueous gelatin solution having yellow colloidal silver dispersed therein, there was added a dispersion containing a solution of 3 g of 2,5-di-t-octylhydroquinone and 1.5 g of di-2-ethylhexylphthalate dissolved in 10 ml of ethyl acetate dispersed in an aqueous gelatin solution containing 0.3 g of sodium triisopropylnaphthalane sulfonate, and the resultant mixture was coated at a proportion of 0.9 g of gelatin/$m^2$ and 0.10 g of 2,5-di-t-octylhydroquinone/$m^2$ to a dried film thickness of 1.2μ.

Tenth layer: Low sensitivity blue sensitive silver halide emulsion layer

A silver iodobromide emulsion with a mean grain size of 0.6μ containing 6 mol % of silver iodide was chemically sensitized with gold and sulfur sensitizers, and further mixed with, as sensitizing dyes, anhydrous 5,5'-dimethoxy-3,3-di-(3-sulfopropyl)thiacyanine hydroxide, followed by addition of 1.0 g of 4-hydroxy-6-methyl-1,3,3a-7-tetrazaindene and 20.0 mg of 1-phenyl-5-mercaptotetrazole to prepare a low sensitivity blue sensitive silver halide emulsion.

Further, per mol of silver halide, there were added as a yellow coupler 120 g of α-pivaloyl-α-(1-benzyl-2-phenyl-3,5-dioxo-1,2,4-triazolidine-4-yl)-2'-chloro-5'-5'-[α-(dodecyloxycarbonyl)ethoxycarbonyl]acetanilide and 50 g of α-{3-[α-(2,4-di-t-amylphenoxy)butylamide]}-benzoyl-2'-methoxyacetanililde and dissolved under heating in a mixture of 120 g of dibutyl phthalate and 300 ml of ethyl acetate, and the resultant solution added into an aqueous gelatin solution containing sodium triisopropylnaphthalene sulfonate, followed by emulsification in a colloid mill. The resultant dispersion was mixed with the above emulsion to prepare a low sensitivity blue sensitive emulsion, which was coated to a dried film thickness of 4.0μ (containing 160 g of gelatin per mole of silver halide).

Eleventh layer: High sensitivity blue sensitive silver halide emulsion layer

A silver iodobromide emulsion with a mean grain size of 1.2μ containing 7 mol % of silver iodide was chemically sensitized with gold and sulfur sensitizers, and further mixed with, as sensitizing dyes, anhydrous 5,5'-dimethoxy-3,3-di-(3-sulfopropyl)thiacyanine hydroxide, followed by addition of 1.0 g of 4-hydroxy-6-methyl-1,3,3a-7-tetrazaindene and 20.0 mg of 1-phenyl-5-mercaptotetrazole to prepare a high sensitivity blue sensitive silver halide emulsion.

Further, per mol of silver halide, there was added as a yellow coupler 80 g of α-pivaloyl-α-(1-benzyl-2-phenyl-3,5-dioxo-1,2,4-triazolidine-4-yl)-2'-chloro-5'-5'-[α-(dodecyloxycarbonyl)ethoxycarbonyl]acetanilide and dissolved under heating in a mixture of 80 g of dibutyl phthalate and 240 ml ethyl acetate, and the resultant solution added into an aqueous gelatin solution containing sodium triisopropylnaphthalene sulfonate, followed by emulsification in a colloid mill. The resultant dispersion was mixed with the above emulsion to prepare a high sensitivity green sensitive emulsion, which was coated to a dried film thickness of 2.0μ (containing 240 g of gelatin per mole of silver halide).

Twelfth layer: Intermediate layer

A dispersion of a mixture of 2 g of di-2-ethylhexylphthalate, 2 g of 2-[3-cyano-3-(n-dodecylaminocarbonyl-)allylidene]-1-ethylpyrolildine and 2 ml of ethyl acetate dispersed in an aqueous gelatin solution containing 0.6 g of sodium triisopropylnaphthalene sulfonate was coated at a proportion of 1.0 g of gelatin/$m^2$ to a dried film thickness of 1.0μ.

Thirteenth layer: Protective layer

An aqueous gelatin solution containing 4 g of gelatin and 0.2 g of 1,2-bisvinylsulfonylethane was coated at a proportion of 1.3 g of gelatin/$m^2$ to a dried film thickness of 1.2μ.

TABLE 5

| Sample | Layer | Cyan coupler | DIR compound | Amount of DIR added |
|---|---|---|---|---|
| 26 | 3rd layer | Control A | D-3 | 0.25 |
| | 4th layer | Control B | D-34 | 0.20 |
| 27 | 3rd layer | Invention 17 | D-3 | 0.25 |

TABLE 5-continued

| Sample | Layer | Cyan coupler | DIR compound | Amount of DIR added |
|---|---|---|---|---|
| | 4th layer | Invention 17 | D-34 | 0.20 |
| 28 | 3rd layer | Invention 8 | D-3 | 0.25 |
| | 4th layer | Invention 8 | D-34 | 0.20 |
| 29 | 3rd layer | Invention 35 | D-3 | 0.25 |
| | 4th layer | Invention 35 | D-34 | 0.20 |
| 30 | 3rd layer | Invention 37 | D-3 | 0.25 |
| | 4th layer | Invention 22 | D-34 | 0.20 |

These high-sensitive multi-layer color nega light-sensitive materials were subjected to wedge exposure and then processing steps as described in Example 1 were conducted.

As the result, the combinations of compounds according to this invention [Samples 27–39] were found to be superior in sensitivity as compared with the Sample (26) of the prior art, being also good in graininess and sharpness without color fading of the cyan dye.

EXAMPLE 6

The couplers of this invention as indicated in Table 6 and Control couplers (A) and (B) as employed in Example 1 were sampled in amounts of 10 mol %, respectively, based on Ag, and the timing DIR compounds of this invention as indicated in Table 6 were added to respective couplers, and each mixture was added to a mixed liquid of dibutyl phthalate in an amount of ½-fold of the coupler weight and ethyl acetate in an amount of three-fold of the coupler weight and completely mixed therein by heating to 60° C. Each solution was mixed with 200 ml of a 5% aqueous gelatin solution containing 20 ml of a 5% aqueous solution of Alkanol B (alkylnaphthalene sulfonate, produced by Du Pont de Nemours & Company), and emulsified in a colloid mill to obtain an emulsified product.

Then, each dispersion was added to 1 Kg of a silver iodobromide emulsion (containing 6% of silver iodide), followed by addition of 20 ml of a 2% solution of 1,2-bis-(vinylsulfonyl)ethane (water:methanol=1:1), and the resultant mixture was coated and dried on an undercoted transparent polyethyleneterephthalate base to prepare Samples (31) to (35) (amount of silver coated: 20 mg/dm$^2$).

The thus obtained Samples (31) to (35) were subjected to wedge exposure in conventional manner and then the same development processing steps as described in Example 1 were applied thereon to obtain the results as shown in Table 6.

The sensitivity values in Table 6 are indicated in terms of the relative values to the sensitivity of Sample—31 as 100.

TABLE 6

| Sample | Coupler | Timing DIR of Invention | Amount of DIR added (mol/Ag mol × 100) | S | $\gamma_2$ |
|---|---|---|---|---|---|
| 31 | Control A | T-23 | 0.2 | 100 | 0.57 |
| 32 | Control B | " | " | 124 | 0.73 |
| 33 | Invention 12 | " | " | 135 | 0.75 |
| 34 | Invention 19 | " | " | 129 | 0.76 |
| 35 | Invention 24 | T-56 | 0.3 | 131 | 0.76 |

From Table 6, it can be seen that the sample employing Control coupler (A) in combination with the timing DIR compound of this invention is low in sensitivity and gamma value, while the sample employing Control cyan coupler (B) or the cyan coupler of this invention in combination with the DIR compound of this invention is high in sensitivity, exhibiting also good gradation characteristic.

EXAMPLE 7

Samples 36–41 were prepared in the same manner as described in Example 3 except for employing the materials and the conditions as indicated in Table 7.

The thus obtained samples 36–41 were exposed to light through wedges with space frequencies varying in the range from 3 lines/mm to 100 lines/mm, subjected to developing treatment in the same manner as in Example—1, and MTF (Modulation Transfer Function) of the obtained color image was determined with a green light. By comparison between the values of MTF at space frequencies of 10 lines/mm and 30 lines/mm, improved effects of sharpness were examined to obtain the results as shown in Table 7.

TABLE 7

| Sample | Coupler | Amount* of coupler | DIR compound of Invention | Amount* of DIR added | Amount of Ag coated (mg/dm$^2$) | Gamma | MTF 10 line/mm | MTF 30 line/mm | λ-max |
|---|---|---|---|---|---|---|---|---|---|
| 36 | Control coupler A | 15 | T-22 | 0.2 | 20 | 0.73 | 105 | 70 | 695 |
| 37 | Control coupler B | 10 | " | " | 20 | 0.75 | 118 | 85 | 695 |
| 38 | Control coupler D | 15 | " | " | 20 | 0.72 | 110 | 78 | 670 |
| 39 | Control coupler E | 10 | " | " | 20 | 0.81 | 120 | 90 | 665 |
| 40 | Coupler of Invention 30 | " | " | " | 20 | 0.76 | 125 | 93 | 695 |
| 41 | Coupler of Invention 38 | " | T-48 | " | 20 | 0.77 | 128 | 95 | 696 |

*Amounts of coupler and DIR added: compound mol/Ag mol × 100

Table 7 shows that the sample employing Control coupler (A) is undesirably deteriorated in sharpness, although color formed density is increased by increase of the amount of coupler, and the sample employing Control couplers (D) and (E) exhibits a short wavelength of λ-max with greater by-absorption at the green portion which is not favorable with respect to color reproduction. In contrast, the samples employing in combination the coupler and the timing DIR compound according to this invention are good both in graininess and sharpness, with the spectroscopic absorption spectrum being also good with long wavelengths.

EXAMPLE 8

Example—4 was repeated except that Samples (36) to (41) were employed in place of Samples (21) to (25). The results are shown in Table 8.

TABLE 8

| Sample | Residual dye percentage (%) |
|---|---|
| 36 | 75 |
| 37 | 72 |
| 38 | 99 |
| 39 | 74 |
| 40 | 99 |
| 41 | 100 |

From Table 8, it can be seen that the samples employing the cyan couplers of this invention are good without color fading of the cyan dye even after the bleaching fixing processing, but color fading was observed in samples employing Control couplers, A, B and E.

EXAMPLE 9

Example 5 was repeated except that the timing DIR compounds of this invention were employed as indicated in Table 9 in place of the non-timing DIR compounds in Example 5 to obtain the results as shown in Table 9.

TABLE 9

| Sample | Layer | Cyan coupler | Colored cyan coupler | Timing DIR compound | Amount of DIR added |
|---|---|---|---|---|---|
| 42 | 3rd | Control A | CC-1 | Invention T-23 | 0.13 |
| | 4th | Control B | None | Invention T-53 | 0.1 |
| 43 | 3rd | Invention 32 | CC-1 | Invention T-23 | 0.16 |
| | 4th | Invention 32 | None | Invention T-53 | 0.15 |

*Amount of DIR added: DIR mol/Ag mol × 100

CC-1:

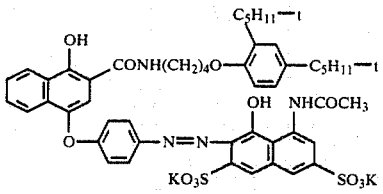

The Samples 42 and 43 thus obtained were subjected to wedge exposure with a red light, then exposed uniformly to a green light at a dose such that the green light density may be 1.5, followed by development processing steps similarly as described in Example 1.

The results obtained for the Samples 42 and 43 after development processing steps are shown in Table 10 below.

The inter-image effect to the green sensitive layer was calculated as follows. The green sensitive layer is originally uniformly exposed to the light so that the density may become 1.5, but it is shown in terms of a ratio reduced in green light density as the result of inhibition of development in the green sensitive layer corresponding to the density developed in the red sensitive layer due to the inter-image effect. When the green light density at the time of maximum red light density is expressed by $D_1$, the strength of the inter-image may be represented by the following formula:

$$\frac{1.5 - D_1}{1.5} \times 100$$

That is, as the increase of this value, the inter-image effect is stronger to give more improvement of color reproduction.

TABLE 10

| Sample | Red sensitive layer $\gamma_2$ | Inter-image effect (%) |
|---|---|---|
| 42 (Control) | 0.63 | 9 |
| 43 (Invention) | 0.63 | 14 |

From Table 10, it can be seen that the inter-image effect to the green sensitive layer is greater in the Sample (43) according to this invention than in Control at approximately the same of level of $\gamma_2$ in the red sensitive layer, whereby there can be obtained a light-sensitive multi-layer silver halide material with good color reproduction.

EXAMPLE 10

Example 1 was repeated except that the couplers of this invention and Control couplers (A) and (B) were combined, respectively, with both of the timing DIR compounds and the non-timing DIR compounds of this invention as indicated in Table 11.

The results obtained are also shown in Table 11. The sensitivity values are given as relative values to that of Sample—44.

As can be clearly seen from Table 1, when the timing DIR of this invention and the non-timing DIR of this invention are applied to the cyan coupler of this invention, sensitivity is found to be increased. It will be understood that by using non-timing DIR and timing DIR in combination, the coupler of this invention can give good gradation characteristic with little lowering in sensitivity.

TABLE 11

| Sample | Coupler | Timing DIR | Amount* of timing DIR added | Non-timing DIR | Amount* of non-timing added | S | $\gamma_2$ |
|---|---|---|---|---|---|---|---|
| 44 | Control A | T-23 | 0.05 | D-3 | 0.3 | 100 | 0.56 |
| 45 | Control B | T-23 | 0.05 | D-3 | 0.3 | 120 | 0.73 |
| 46 | Coupler 12 | T-23 | 0.05 | D-3 | 0.3 | 131 | 0.75 |

*Amount of DIR added: compound mol/Ag mol × 100

EXAMPLE 11

Example 3 was repeated by use of the Control couplers (A) and (E) and the couplers of this invention in combination with the timing DIR compounds and/or the non-timing DIR compounds of this invention as indicated in Table 12 to obtain the results as shown in the same Table.

Table 12 clearly shows that satisfactory improvements can be obtained with respect to both graininess and sharpness in Sample (55) in which both timing DIR and non-timing DIR are used in combination.

TABLE 12

| Sample | Coupler | Timing DIR | Amount* of timing DIR added | Non-timing DIR | Amount* of non-timing added | Amount of Ag coated (mg/dm$^2$) | $\gamma_2$ | RMS | MTF 10 line/mm |
|---|---|---|---|---|---|---|---|---|---|
| 47 | Control A | T-22 | 0.2 | — | — | 25 | 0.75 | 40 | 109 |
| 48 | " | — | — | D-33 | 0.5 | 25 | 0.77 | 35 | 100 |
| 49 | " | T-22 | 0.05 | D-33 | 0.25 | 25 | 0.74 | 35 | 108 |
| 50 | Control E | T-22 | 0.2 | — | — | 20 | 0.75 | 39 | 120 |
| 51 | " | — | — | D-33 | 0.5 | " | 0.78 | 35 | 109 |
| 52 | " | T-22 | 0.05 | D-33 | 0.25 | " | 0.76 | 34 | 119 |
| 53 | Coupler 32 of Invention | T-22 | 0.2 | — | — | " | 0.77 | 38 | 126 |
| 54 | Coupler 32 of Invention | — | — | D-33 | 0.5 | " | 0.75 | 33 | 113 |
| 55 | Coupler 32 of Invention | T-22 | 0.05 | D-33 | 0.25 | " | 0.74 | 32 | 126 |

*Amount of DIR added: Compound mol/Ag mol × 100

EXAMPLE 12

Example 4 was repeated except that the samples (49), (52) and (55) obtained in Example 11 were used in place of the samples used in Example 4 to obtain the results as shown in Table 13.

TABLE 13

| Sample | Residual dye percentage (%) | Ag removal characteristic (mg/dm2) |
|---|---|---|
| 49 | 67 | 0.92 |
| 52 | 73 | 0 |
| 55 | 99 | 0 |

Table 13 clearly shows that the cyan couplers of this invention are free from color fading of the cyan dyes during the bleaching fixing processing, with good Ag removal characteristics.

EXAMPLE 13

Example 9 was repeated except that the cyan couplers, colored cyan couplers, the timing DIR compounds and the non-timing DIR compounds as indicated in Table 14 were employed in the third and fourth layers in place of the materials used in Example 9 to obtain the results shown in Table 15.

TABLE 14

| Sample | Layer | Cyan coupler | Colored cyan coupler | Timing DIR | Amount* of timing DIR added | Non-timing DIR | Amount of non-timing DIR added |
|---|---|---|---|---|---|---|---|
| 56 | 3rd | Control A | CC-1 | Invention T-23 | 0.12 | None | None |
| | 4th | Control B | None | Invention T-53 | 0.03 | Invention D-34 | 0.05 |
| 57 | 3rd | Invention 38 | CC-1 | Invention T-23 | 0.18 | None | None |
| | 4th | Invention 50 | None | Invention T-53 | 0.05 | Invention D-34 | 0.07 |

*Amount of DIR added: compound mol/Ag mol × 100

TABLE 15

| Sample | Red sensitive layer $\gamma_2$ | Inter-image effect (%) |
|---|---|---|
| 56 (Control) | 0.62 | 8 |
| 57 (Invention) | 0.63 | 14 |

TABLE 15-continued

From Table 15, it can be seen that the inter-image effect to the green sensitive layer is greater in the Sample (57) according to this invention than in Control at approximately the same level of $\gamma_2$ in the red sensitive layer, whereby there can be obtained a light-sensitive multi-layer silver halide material with good color reproduction.

We claim:

1. A light-sensitive silver halide color photographic material having at least one light-sensitive silver halide emulsion layer on a support, characterized in that said light-sensitive silver halide emulsion layer contains a cyan coupler represented by formula (I) shown below, and wherein at least one of said light-sensitive silver halide emulsion layer and a layer contiguous to said light-sensitive silver halide emulsion layer contains a timing DIR compound represented by the formula (II):

Formula (I)

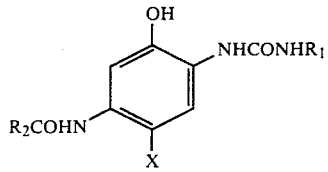

wherein X represents a hydrogen atom or a group which is capable of being eliminated by a coupling reaction with an oxidized product of an aromatic primary amine color developing agent; $R_1$ is an aryl group; or a heterocyclic group; and $R_2$ is a ballast group necessary for imparting diffusion resistance to a cyan coupler represented by formula (I) and a cyan dye to be formed from said cyan coupler, Formula (II)

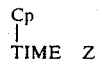

wherein Cp represents a coupling component which is reactive with an oxidized product of an aromatic primary amine color developing agent, TIME represents a timing group which releases Z after the coupling reaction of Cp and Z represents a development inhibitor; and TIME is a group represented by the following formulae (IV), (V) or (VI):

Formula (IV)

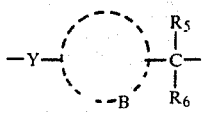

wherein B represents a group of atoms necessary for completion of a benzene ring or a naphthalene ring; Y represents —O—, —S—, or

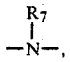

which is bonded to the active site of Cp; $R_5$, $R_6$ and $R_7$ each represent a hydrogen atom, an alkyl group or an aryl group; and the group

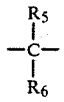

is substituted at an ortho position or a para position relative to Y and bonded to a hetero atom included in Z;

Formula (V)

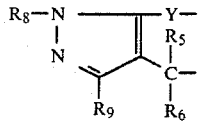

wherein Y, $R_5$ and $R_6$ have the same meanings as defined in formula (IV); $R_8$ is selected from the group consisting of a hydrogen atom, an alkyl group, an aryl group, an acyl group, a sulfone group, an alkoxycarbonyl group and a heterocyclic ring residue; and $R_9$ is selected from the group consisting of a hydrogen atom, an alkyl group, an aryl group, a heterocyclic ring residue, an alkoxy group, an amino group, an acid amide group, a sulfonamide group, a carboxylic group, an alkoxycarbonyl group, a carbamoyl group and a cyano group, said timing group being bonded through Y to the active site of Cp through

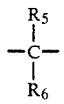

group to a hetero atom in Z; or

Formula (VI)

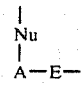

wherein Nu is a nucleophilic group having an oxygen, sulfur or nitrogen atom enriched in electrons and bonded to the coupling position of Cp; E is an electrophilic group having a carbonyl group, a thiocarbonyl group, a phosphinyl group or a thiophosphinyl group and bonded to a hetero atom in Z; and A is a steric correlation between Nu and E, and wherein A is a bonding group which is subject to an intramolecular nucleophilic reaction accompanied with the formation of a three-membered ring to a seven-membered ring after Nu has been released from Cp and can release Z through said nucleophilic reaction.

2. A light-sensitive silver halide color photographic material having at least one light-sensitive silver halide emulsion layer on a support, characterized in that said light-sensitive silver halide emulsion layer contains a cyan coupler represented by formula (I) shown below, and wherein at least one of said light-sensitive silver halide emulsion layer and a layer contiguous to said light-sensitive silver halide emulsion layer contains a timing DIR compound represented by formula (II) shown below and a non-timing type DIR compound:

Formula (I)

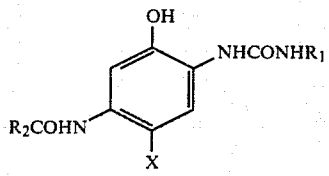

wherein X represents a hydrogen atom or a group which is capable of being eliminated by a coupling reaction with an oxidized product of an aromatic primary amine color developing agent; $R_1$ is an aryl group, or a heterocyclic group; and $R_2$ is a ballast group necessary for imparting diffusion resistance to a cyan coupler represented by formula (I) and a cyan dye to be formed from said cyan coupler, Formula (II)

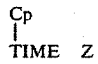

wherein Cp represents a coupling component which is reactive with an oxidized product of an aromatic primary amine color developing agent, TIME represents a timing group which releases Z after the coupling reaction of Cp and Z represents a development inhibitor; and TIME is a group represented by the following formulae (IV), (V), or (VI):

Formula (IV)

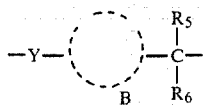

wherein B represents a group of atoms necessary for completion of a benzene ring or a naphthalene ring; Y represents —O—, —S—, or

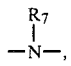

which is bonded to the active site of Cp; $R_5$, $R_6$ and $R_7$ each represent a hydrogen atom, an alkyl group or an aryl group; and the group

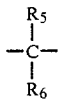

is substituted at an ortho position or a para position relative to Y and bonded to a hetero atom in Z;

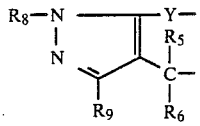

Formula (V)

wherein Y, $R_5$ and $R_6$ have the same meanings as defined in the formula (IV); $R_8$ is selected from the group consisting of a hydrogen atom, an alkyl group, an aryl group, an acyl group, a sulfone group, an alkoxycarbonyl group and a heterocyclic ring residue; and $R_g$ is selected from the group consisting of a hydrogen atom, an alkyl group, an aryl group, a heterocyclic ring residue, an alkoxy group, an amino group, an acid amide group, a sulfonamide group, a carboxylic group, an alkoxycarbonyl group, a carbamoyl group and a cyano group, said timing group being bonded through Y to the active site of Cp and through

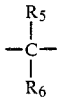

group to a hetero atom in Z; or

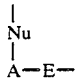

Formula (VI)

wherein Nu is a nucleophilic group having an oxygen, sulfur or nitrogen atom enriched in electrons and bonded to the coupling position of Cp; E is an electrophilic group having a carbonyl group, a thiocarbonyl group, a phosphinyl group or a thiophosphinyl group and bonded to a hetero atom in Z; and A is a steric correlation between Nu and E, and wherein A is a bonding group which is subject to an intramolecular nucleophilic reaction accompanied with formation of a three-membered ring to a seven-membered ring after Nu has been released from Cp and can release Z through said nucleophilic reaction.

* * * * *